US010204547B2

(12) United States Patent
Park

(10) Patent No.: US 10,204,547 B2
(45) Date of Patent: Feb. 12, 2019

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventor: Suhyeong Park, Gyeongju-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 222 days.

(21) Appl. No.: 15/098,788

(22) Filed: Apr. 14, 2016

(65) Prior Publication Data

US 2016/0372028 A1 Dec. 22, 2016

(30) Foreign Application Priority Data

Jun. 22, 2015 (KR) ..... 10-2015-0088392

(51) Int. Cl.
*G09G 3/36* (2006.01)
*G09G 3/20* (2006.01)
*G09G 3/3275* (2016.01)

(52) U.S. Cl.
CPC ..... *G09G 3/2096* (2013.01); *G09G 3/3275* (2013.01); *G09G 3/3688* (2013.01); *G09G 2310/027* (2013.01); *G09G 2310/0289* (2013.01); *G09G 2310/08* (2013.01); *G09G 2330/021* (2013.01); *G09G 2330/028* (2013.01)

(58) Field of Classification Search
CPC .. G09G 3/20; G09G 3/36; G09G 3/32; G09G 5/00; G11C 19/00; G02F 1/1345; G06F 3/038
See application file for complete search history.

(56) References Cited

U.S. PATENT DOCUMENTS 8,310,507 B2 11/2012 Hiratsuka
8,466,908 B2 6/2013 Yen
8,963,448 B2 2/2015 Kim et al.
2004/0262653 A1* 12/2004 Senda ..... G09G 3/20 257/292
2010/0013869 A1* 1/2010 Matsumoto ..... G09G 3/2011 345/690

(Continued)

FOREIGN PATENT DOCUMENTS

KR 1020080067493 A 7/2008
KR 1020130128933 A 11/2013
KR 1020130139586 A 12/2013

*Primary Examiner* — Pegeman Karimi
(74) *Attorney, Agent, or Firm* — Cantor Colburn LLP

(57) ABSTRACT

A display device includes a buffer connected to a data line of a display panel, a bias-mode verification unit which generates a bias-mode signal based on an $n^{th}$ image data signal and an $m^{th}$ image data signal ("m" is a natural number smaller than "n") corresponding to the data line, a data selecting unit which selects one of a plurality of bias enable signals having different duty ratios from one another based on the bias-mode signal, a control signal generating unit which generates a switching control signal based on the bias enable signal selected by the data selecting unit, and a bias control unit which applies, to the buffer, at least one of a plurality of bias control signals having different levels from one another in an output period defined by the switching control signal.

27 Claims, 11 Drawing Sheets

(56) References Cited

U.S. PATENT DOCUMENTS

| | | | | |
|---|---|---|---|---|
| 2011/0316901 | A1 | 12/2011 | Park et al. | |
| 2012/0013587 | A1* | 1/2012 | Yen | G09G 3/3688 345/211 |
| 2013/0307838 | A1* | 11/2013 | Kim | G09G 5/001 345/212 |
| 2013/0334985 | A1* | 12/2013 | Kim | H03F 3/3022 315/307 |
| 2014/0160104 | A1 | 6/2014 | Lin et al. | |

* cited by examiner

DISPLAY DEVICE AND METHOD FOR DRIVING THE SAME

This application claims priority to Korean Patent Application No. 10-2015-0088392, filed on Jun. 22, 2015, and all the benefits accruing therefrom under 35 U.S.C. § 119, the content of which in its entirety is herein incorporated by reference.

BACKGROUND

1. Field

Exemplary embodiments of the invention relate to a display device capable of reducing power consumption and to a method of driving the display device.

2. Description of the Related Art

With advancements in display devices toward high definition and a large screen, high-current driving capability is required in a data driver so as to display an image of high quality.

SUMMARY

Due to a data driver which displays an image of high quality, there arises an issue of increasing power consumption.

Exemplary embodiments of embodiments of the invention are directed to a display device capable of reducing power consumption of a data driver by adjusting a bias current using bias enable signals having different duty ratios based on an amount of variation in an image data signal, and to a method of driving the display device.

According to an exemplary embodiment, a display device includes a buffer connected to a data line of a display panel, a bias-mode verification unit which generates a bias-mode signal based on an $n^{th}$ image data signal and an $m^{th}$ image data signal ("m" is a natural number smaller than "n") corresponding to the data line, a data selecting unit which selects one of a plurality of bias enable signals having different duty ratios from one another based on the bias-mode signal, a control signal generating unit which generates a switching control signal based on the bias enable signal selected by the data selecting unit, and a bias control unit which applies, to the buffer, at least one of a plurality of bias control signals having different levels from one another in an output period defined by the switching control signal.

In an exemplary embodiment, the plurality of bias control signals may include a first bias control signal and a second bias control signal having a level less than a level of the first bias control signal.

In an exemplary embodiment, the output period may include at least one first output period corresponding to a low period of the switching control signal, and at least one second output period corresponding to a high period of the switching control signal.

In an exemplary embodiment, the bias control unit may output the first bias control signal in the first output period and output the second bias control signal in the second output period.

In an exemplary embodiment, the bias control unit may include a first input terminal to which one of the first bias control signal and the second bias control signal is input, a second input terminal to which another of the first bias control signal and the second bias control signal is input, an output terminal connected to the buffer, a p-type first switching element controlled by the switching control signal and connected between the first input terminal and the output terminal, and an n-type second switching element controlled by the switching control signal and connected between the second input terminal and the output terminal.

In an exemplary embodiment, the switching control signal may include a first switching control signal and a second switching control signal having phases opposite to each other, respectively.

In an exemplary embodiment, the output period may include at least one first output period corresponding to a low period of the first switching control signal and a high period of the second switching control signal, and at least one second output period corresponding to a high period of the first switching control signal and a low period of the second switching control signal.

In an exemplary embodiment, the bias control unit may include a first input terminal to which one of the first bias control signal and the second bias control signal is input, a second input terminal to which another of the first bias control signal and the second bias control signal is input, an output terminal connected to the buffer, a p-type first switching element controlled by the first switching control signal and connected between the first input terminal and the output terminal, an n-type second switching element controlled by the second switching control signal and connected between the first input terminal and the output terminal, a p-type third switching element controlled by the second switching control signal and connected between the second input terminal and the output terminal, and an n-type fourth switching element controlled by the first switching control signal and connected between the second input terminal and the output terminal.

In an exemplary embodiment, the switching control signal applied from the control signal generating unit may have a level greater than a level of the bias enable signal selected by the data selecting unit.

In an exemplary embodiment, the first switching control signal and the second switching control signal applied from the control signal generating unit may have a level greater than the level of the bias enable signal selected by the data selecting unit.

In an exemplary embodiment, the bias-mode verification unit may generate the bias-mode signal based on a difference value between the $n^{th}$ image data signal and the $m^{th}$ image data signal.

In an exemplary embodiment, the bias-mode verification unit may generate the bias-mode signal based on a difference value between upper "k" number of bits ("k" is a natural number) of the $n^{th}$ image data signal and upper "k" number of bits of the $m^{th}$ image data signal.

In an exemplary embodiment, the display device may further include an integrated control unit which generates the plurality of bias enable signals, the first bias control signal, and the second bias control signal.

In an exemplary embodiment, the integrated control unit may include a signal applying unit which generates the first bias control signal, a bias level control signal B_STEP, and a plurality of parameter signals, a signal modulation unit which generates the second bias control signal based on the first bias control signal and the bias level control signal, and a clock counter which generates the plurality of bias enable signals based on the plurality of parameter signals and an externally input clock signal.

In an exemplary embodiment, the clock counter may generate the plurality of bias enable signals based on a count value of the clock signals, a start point in time of the respective bias enable signals included in the plurality of parameter signals, respectively, and an end point in time of the respective bias enable signals included in the plurality of parameter signals, respectively.

In an exemplary embodiment, the control signal generating unit may include an input terminal to which the bias enable signal is input from the data selecting unit, a first output terminal to which the first switching control signal is output, a second output terminal to which the second switching control signal is output, an inverting unit which generates an inverted bias enable signal based on the bias enable signal input to the input terminal, an intermediate control unit which generates a first intermediate control signal and a second intermediate control signal based on the bias enable signal applied from the data selecting unit and the inverted bias enable signal applied from the inverting unit, and an output unit which generates the first switching control signal and the second switching control signal based on the first intermediate control signal and the second intermediate control signal applied from the intermediate control unit to thereby output the first switching control signal and the second switching control signal to the first output terminal and the second output terminal.

In an exemplary embodiment, the inverting unit may include a p-type first switching element controlled by the bias enable signal applied from the input terminal and connected between a first high-voltage power line transmitting a first high voltage and an inverting terminal, and an n-type second switching element controlled by the bias enable signal applied from the input terminal and connected between the inverting terminal and a first low-voltage power line transmitting a first low voltage.

In an exemplary embodiment, the intermediate control unit may include an n-type third switching element controlled by the bias enable signal applied from the input terminal and connected between a first intermediate terminal and the first low-voltage power line, an n-type fourth switching element controlled by the inverted bias enable signal applied from the inverting terminal and connected between a second intermediate terminal and the first low-voltage power line, a p-type fifth switching element controlled by the second intermediate control signal applied from the second intermediate terminal and connected between a second high-voltage power line transmitting a second high voltage and the first intermediate terminal, and a p-type sixth switching element controlled by the first intermediate control signal applied from the first intermediate terminal and connected between the second high-voltage power line and the second intermediate terminal.

In an exemplary embodiment, the output unit may include a p-type seventh switching element controlled by the first intermediate control signal applied from the first intermediate terminal and connected between the second high-voltage power line and the first output terminal, a p-type eighth switching element controlled by the second intermediate control signal applied from the second intermediate terminal and connected between the second high-voltage power line and a second output terminal, an n-type ninth switching element controlled by the second switching control signal applied from the second output terminal and connected between the first output terminal and a second low-voltage power line transmitting a second low voltage, and an n-type tenth switching element controlled by the first switching control signal applied from the first output terminal and connected between the second output terminal and the second low-voltage power line.

According to an exemplary embodiment, a method of driving a display device including a buffer connected to a data line of a display panel includes generating a bias-mode signal based on an $n^{th}$ image data signal and an $m^{th}$ image data signal ("m" is a natural number smaller than "n") corresponding to the data line, selecting one of a plurality of bias enable signals having different duty ratios from one another based on the bias-mode signal, generating a switching control signal based on the selected bias enable signal, and applying, to the buffer, at least one of a plurality of bias control signals having different levels from one another in an output period defined by the switching control signal.

In an exemplary embodiment, the plurality of bias control signals may include a first bias control signal and a second bias control signal having a level less than a level of the first bias control signal.

In an exemplary embodiment, the output period may include a first output period corresponding to a low period of the switching control signal, and a second output period corresponding to a high period of the switching control signal.

In an exemplary embodiment, the applying of at least one of the plurality of bias control signals to the buffer may include applying the first bias control signal to the buffer in the first output period, and applying the second bias control signal to the buffer in the second output period.

In an exemplary embodiment, the switching control signal may include a first switching control signal and a second switching control signal having phases opposite to each other.

In an exemplary embodiment, the output period may include a first output period corresponding to a low period of the first switching control signal and a high period of the second switching control signal, and a second output period corresponding to a high period of the first switching control signal and a low period of the second switching control signal.

In an exemplary embodiment, the switching control signal may have a level greater than a level of the selected bias enable signal.

In an exemplary embodiment, the first switching control signal and the second switching control signal may have a level greater than the level of the selected bias enable signal.

The foregoing is illustrative only and is not intended to be in any way limiting. In addition to the illustrative exemplary embodiments, embodiments, and features described above, further exemplary embodiments, embodiments, and features will become apparent by reference to the drawings and the following detailed description.

BRIEF DESCRIPTION OF THE DRAWINGS

The above and other features and exemplary embodiments of the invention will be more clearly understood from the following detailed description taken in conjunction with the accompanying drawings, in which.

DETAILED DESCRIPTION

Figure 1:
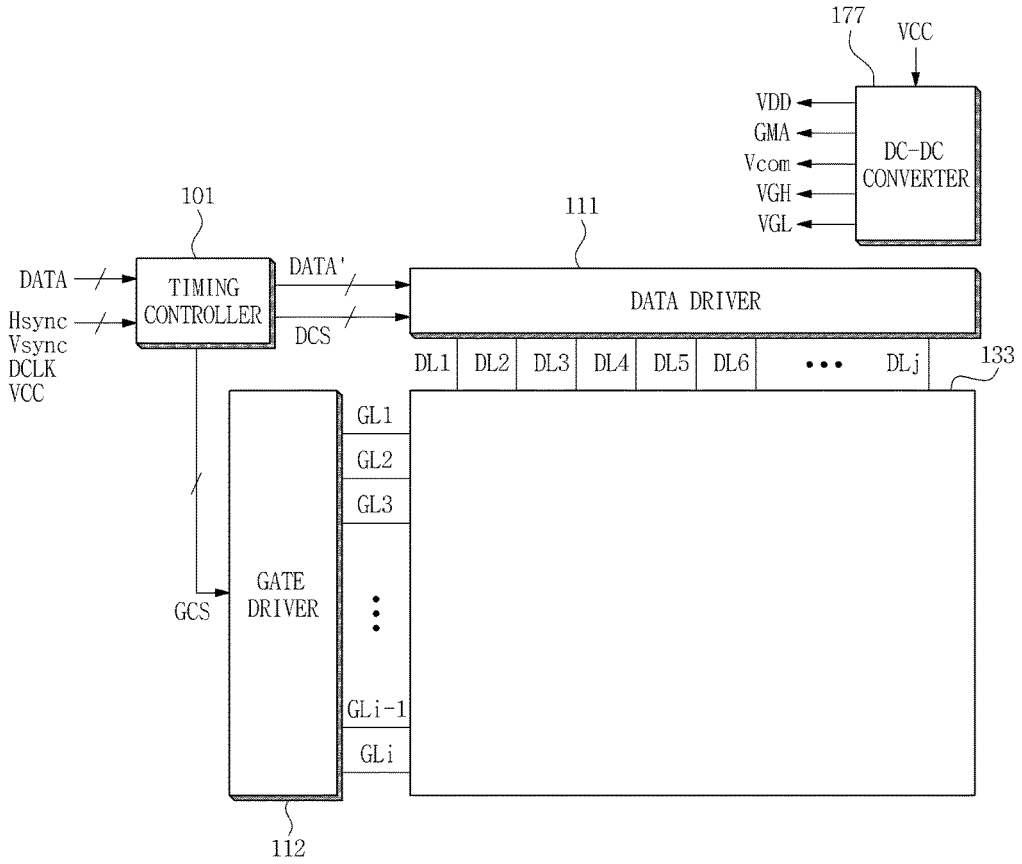
FIG. 1 is a block diagram illustrating an exemplary embodiment a display device according to the invention.

Advantages and features of the invention and methods for achieving them will be made clear from exemplary embodiments described below in detail with reference to the accompanying drawings. The invention may, however, be embodied in many different forms and should not be construed as being limited to the exemplary embodiments set forth herein. Rather, these exemplary embodiments are provided so that this disclosure will be thorough and complete, and will fully convey the scope of the invention to those skilled in the art. The invention is merely defined by the scope of the claims. Therefore, well-known constituent elements, operations and techniques are not described in detail in the exemplary embodiments in order to prevent the invention from being obscurely interpreted. Like reference numerals refer to like elements throughout the specification.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be present therebetween. Conversely, when a layer, area, or plate is referred to as being "directly below" another layer, area, or plate, intervening layers, areas, or plates may be absent therebetween.

The spatially relative terms "below", "beneath", "less", "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Figure 2:
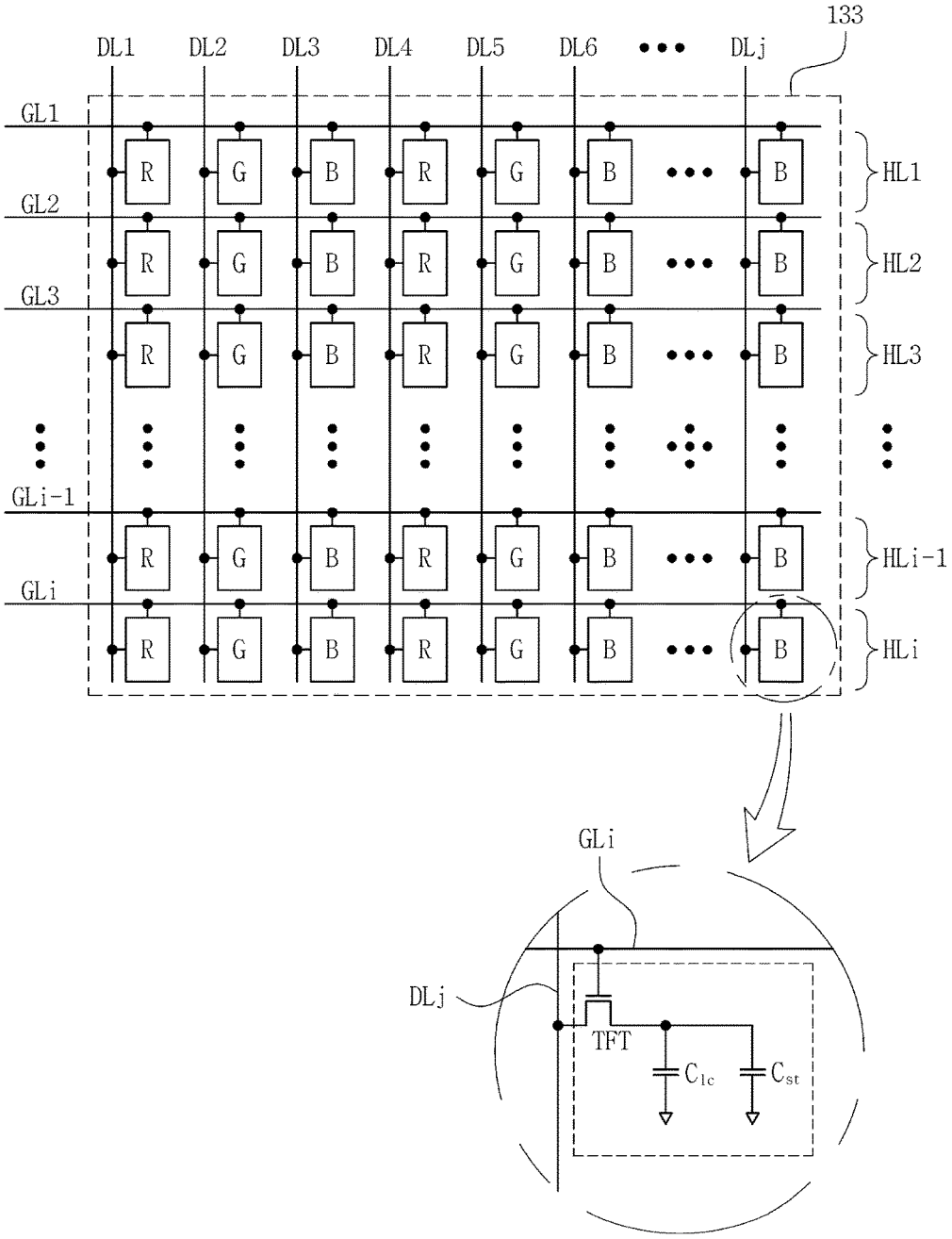
FIG. 2 is a detailed configuration view illustrating a display panel of FIG. 1.

FIG. 1 is a block diagram illustrating a display device according to an exemplary embodiment. FIG. 2 is a detailed configuration view illustrating a display panel 133 of FIG. 1.

The display device, as illustrated in FIG. 1, includes the display panel 133, a timing controller 101, a gate driver 112, a data driver 111, and a direct current ("DC")-DC converter 177.

The display panel 133 displays images. In an exemplary embodiment, the display panel 133 may be a liquid crystal display ("LCD") panel or an organic light emitting diode ("OLED") panel, for example. Hereinafter, the display panel 133 is described as the LCD panel by way of example.

Although not illustrated, the display panel 133 includes a liquid crystal layer and a lower substrate and an upper substrate opposing each other with the liquid crystal layer interposed therebetween.

On the lower substrate, a plurality of gate lines GL1 to GLi, a plurality of data lines DL1 to DLj intersecting the gate lines GL1 to GLi, and thin film transistors ("TFT") connected to the gate lines GL1 to GLi and the data lines DL1 to DLj may be disposed.

Although not illustrated, a black matrix, a plurality of color filters, and a common electrode are disposed on the upper substrate. The black matrix is disposed on a portion of the upper substrate, aside from a portion corresponding to a pixel region. The color filters are disposed in the pixel region. The color filters are categorized into a red color filter, a green color filter, and a blue color filter.

Pixels R, G, and B are arranged in a matrix form. The pixels R, G, and B are categorized into red pixels R disposed corresponding to the red color filter, green pixels G disposed corresponding to the green color filter, and blue pixels B disposed corresponding to the blue color filter. In this regard, the red pixel R, the green pixel G, and the blue pixel B that are adjacently disposed in a horizontal direction may form a unit pixel for displaying a unit image.

There are 1" number of pixels arranged along an $n^{th}$ (n is a number selected from 1 to i) horizontal line (hereinafter, $n^{th}$ horizontal line pixels), and the $n^{th}$ horizontal line pixels are connected to the first to the $j^{th}$ data lines DL1 to DLj, respectively. Further, the $n^{th}$ horizontal line pixels are connected to the $n^{th}$ gate line together. Accordingly, the $n^{th}$ horizontal line pixels receive an $n^{th}$ gate signal as a common signal. That is, "j" number of pixels arranged in the same horizontal line may receive the same gate signal, while pixels arranged in different horizontal lines may receive different gate signals, respectively. In an exemplary embodiment, each of the red pixel R and the green pixel G on the first horizontal line HL1 receives a first gate signal, while the red pixel R and the green pixel G disposed on the second horizontal line HL2 receive a second gate signal that has a timing different from that of the first gate signal, for example.

Each of the pixels R, G, and B includes a TFT, a liquid crystal capacitor Clc, and a storage capacitor Cst, as illustrated in FIG. 2.

The TFT is turned on according to a gate signal applied from the gate line. The turned-on TFT supplies an analog image data signal applied from the data line to the liquid crystal capacitor Clc and the storage capacitor Cst.

The liquid crystal capacitor Clc includes a pixel electrode and a common electrode opposing each other.

The storage capacitor Cst includes a pixel electrode and an opposing electrode opposing each other. Herein, the opposing electrode may be a previous gate line or a common line that transmits a common voltage.

Among elements constituting the pixels R, G, and B, the TFT is covered by the black matrix.

The timing controller 101 receives a vertical synchronization signal Vsync, a horizontal synchronization signal Hsync, an image data signal DATA, and a reference clock signal DCLK output from a graphic controller provided in a system. As an interface circuit (not illustrated) is provided between the timing controller 101 and the system, the aforementioned signals output from the system are input to the timing controller 101 through the interface circuit. The interface circuit may be embedded in the timing controller 101.

Although not illustrated, the interface circuit may include a low voltage differential signaling ("LVDS") receiver. The interface circuit lowers a voltage level of the vertical synchronization signal Vsync, the horizontal synchronization signal Hsync, the image data signal DATA, and the reference clock signal DCLK output from the system, but also increases a frequency of the signals.

Due to a high-frequency component of the signal input from the interface circuit to the timing controller 101, electromagnetic interference ("EMI") may be caused therebetween. In order to prevent the EMI interference, an EMI filter (not illustrated) may further be provided between the interface circuit and the timing controller 101.

The timing controller 101 generates a gate control signal GCS for controlling the gate driver 112 and a data control signal DCS for controlling the data driver 111 based on the vertical synchronization signal Vsync, the horizontal synchronization signal Hsync, and the reference clock signal DCLK. In an exemplary embodiment, the gate control signal GCS may include a gate start pulse, a gate shift clock, a gate output enable signal, and the like, for example. In an exemplary embodiment, the data control signal DCS may include a source start pulse, a source shift clock, a source output enable signal, a polarity signal, and the like, for example.

In addition, the timing controller 101 rearranges the image data signals DATA input through the system and supplies a rearranged image data signals DATA' to the data driver 111.

The timing controller 101 is operated by a driving power VCC output from a power unit provided in the system. In particular, the driving power VCC is used as a power voltage of a phase lock loop ("PLL") embedded in the timing controller 101. The PLL compares the reference clock signal DCLK input to the timing controller 101 with a reference frequency generated by an oscillator. In a case where it is verified from the comparison that there is a difference between the reference clock signal DCLK and the reference frequency, the PLL adjusts the frequency of the reference clock signal DCLK by the difference so as to generate a sampling clock signal. The sampling clock signal is a signal used to perform sampling of the image data signals DATA'.

The DC-DC converter 177 increases or decreases the driving power VCC input through the system so as to generate various voltages required for the display panel 133. To this end, the DC-DC converter 177, for example, may include an output switching element for switching an output voltage of an output terminal thereof and a pulse width modulator ("PWM") for adjusting the duty ratio or the frequency of a control signal applied to a control terminal of the output switching element so as to increase or decrease the output voltage. Herein, the DC-DC converter 177 may include a pulse frequency modulator ("PFM"), in lieu of the pulse width modulator PWM.

The pulse width modulator PWM increases the duty ratio of the aforementioned control signal to thereby increase the output voltage of the DC-DC converter 177 or decrease the duty ratio of the control signal to thereby lower the output voltage of the DC-DC converter 177. The pulse frequency modulator PFM may increase a frequency of the aforementioned control signal to thereby increase the output voltage of the DC-DC converter 177 or decrease the frequency of the control signal to thereby lower the output voltage of the DC-DC converter 177. The output voltage of the DC-DC converter 177 may include a reference voltage VDD of about 6 [V] or more, a gamma reference voltage GMA of lower than level 10, a common voltage in a range from about 2.5 [V] to about 3.3 [V], a gate high voltage VGH of about 15 [V] or more, and a gate low voltage VGL of about −4 [V] or lower.

The gamma reference voltages GMA are a voltage generated by voltage division of the reference voltage. The gamma reference voltages GMA are an analog voltage and are provided to the data driver 111. A common voltage Vcom is applied to a common electrode of the display panel 133 via the data driver 111. A gate high voltage is a high logic voltage of the gate signal, which is set to be a threshold voltage or more of the TFT, and a gate low voltage is a low logic voltage of the gate signal, which is set to be an off-voltage of the TFT. The gate high voltage and the gate low voltage are applied to the gate driver 112.

The gate driver 112 generates gate signals according to the gate control signal GCS applied from the timing controller 101 and sequentially applies the gate signals to the plurality of gate lines GL1 to GLi. The gate driver 112, for example, may include a shift register that shifts the gate start pulse according to the gate shift clock to thereby generate gate signals. The shift register may include a plurality of switching elements. The switching elements may be formed on the lower substrate in the same process as in that of the TFT in a display area.

The data driver 111 receives the image data signals DATA' and the data control signal DCS from the timing controller 101. The data driver 111 samples the image data signals DATA' according to the data control signal DCS, latches the sampled image data signals corresponding to one horizontal line each horizontal period, and applies the latched image data signals to the data lines DL1 to DLj. That is, the data driver 111 converts the image data signals DATA' applied from the timing controller 101 into analog image data signals using the gamma reference voltages GMA input from the DC-DC converter 177 and provides the converted image data signals to the data lines DL1 to DLj.

Figure 3:
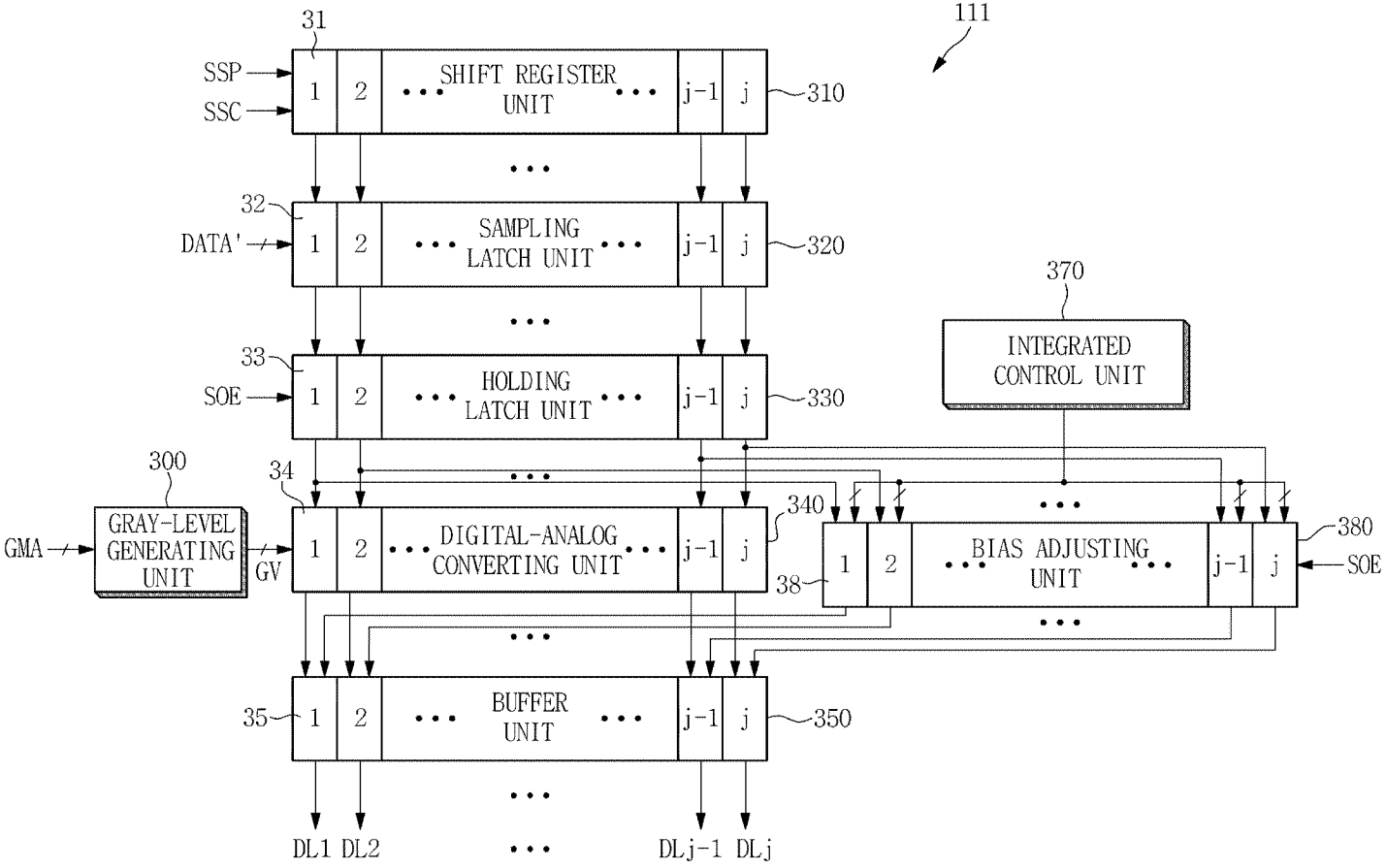
FIG. 3 is a detailed block diagram illustrating a data driver of FIG. 1.

FIG. 3 is a detailed block diagram illustrating the data driver 111 of FIG. 1.

The data driver 111, as illustrated in FIG. 3, includes a shift register unit 310, a sampling latch unit 320, a holding latch unit 330, a gray-level generating unit 300, a digital-analog converting unit 340, and a buffer unit 350.

The shift register unit 310 receives a source shift clock SSC and a source start pulse SSP from the timing controller 101 and shifts the source start pulse SSP at each period of the source shift clock SSC to thereby sequentially generate "j" number of sampling signals. To this end, the shift register unit 310 includes "j" number of shift registers 31.

The sampling latch unit 320 sequentially stores the digital image data signals in response to the sampling signals sequentially applied thereto from the shift register unit 310. Herein, the sampling latch unit 320 includes "j" number of sampling latches 32 for storing "j" number of digital image data signals. In this regard, each of the sampling latches 32 has a storage capacity corresponding to a bit number of the digital image data signal. In an exemplary embodiment, in a case where each of the digital image data signals is composed of "k" number of bits ("k" is a natural number), each of the sampling latches 32 has a storage capacity set to have a size of "k" number of bits, for example.

The holding latch unit 330 simultaneously receives the digital image data signals applied thereto from the sampling latch unit 320 to store the digital image data signals, and simultaneously outputs sampled digital image data signals that are stored in a previous period, in response to a source output enable signal ("SOE"). The digital image data signals output from the holding latch unit 330 are simultaneously applied to the digital-analog converting unit 340. The holding latch unit 330 includes "j" number of holding latches 33 for storing the "j" number of digital image data signals. In addition, each of the holding latches 33 has a storage capacity corresponding to a bit number of the digital image data signal. In an exemplary embodiment, in a case where each of the digital image data signals is composed of "k" number of bits ("k" is a natural number) similar to the foregoing, each of the holding latches 33 has a storage capacity set to have a size of "k" number of bits, for example.

The gray-level generating unit 300 divides the gamma reference voltage GMA applied from the DC-DC converter 177 to thereby generate a plurality of gray voltages GV.

The digital-analog converting unit 340 generates an analog image data signal corresponding to the bit number of the digital image data signal applied from the holding latch unit 340. In detail, the digital-analog converting unit 340 selects a gray voltage corresponding to the bit number of the digital image data signal applied from the holding latch unit 340 in the gray-level generating unit 300, and outputs the selected gray voltage as an analog image data signal. The digital-analog converting unit 340 includes "j" number of digital-analog converters 34 for converting the "j" number of digital image data signals into analog image data signals.

The buffer unit 350 receives the analog image data signals from the digital-analog converting unit 340, amplifies the analog image data signals, and outputs the amplified analog image data signals to the data line DL1~DLj of the display panel 133. The buffer unit 350 includes "j" number of buffers 35 for amplifying the "j" number of analog image data signals.

A bias adjusting unit 380 adjusts a level of bias control signals of the buffer unit 350 based on the image data signals applied from the holding latch unit 330. In this case, a point in time of adjusting the bias control signals is determined based on the source output enable signal SOE. That is, when the source output enable signal SOE is input to the bias adjusting unit 380, the bias adjusting unit 380 adjusts the level of the bias control signals in response to the source output enable signal SOE. The bias adjusting unit 380 includes "j" number of bias adjustors 38 for adjusting the level of the "j" number of bias control signals. Due to the bias adjusting unit 380, the buffer unit 350 may receive the bias control signal suitably adjusted based on an amount of variation of the image data signal. Accordingly, when the amount of variation in the image data signal is relatively small, the level of the bias control signal decreases in proportion thereto, such that power consumption of the data driver 111 may be reduced.

The integrated control unit 370 generates a plurality of bias control signals having different levels from one another and a plurality of bias enable signals having different duty ratios from one another and applies the bias control signals and the bias enable signals to the bias adjusting unit 380. The plurality of bias control signals and the plurality of bias enable signals applied from the integrated control unit 370 are applied to each of the bias adjustors 38 as a common signal.

Figure 4:
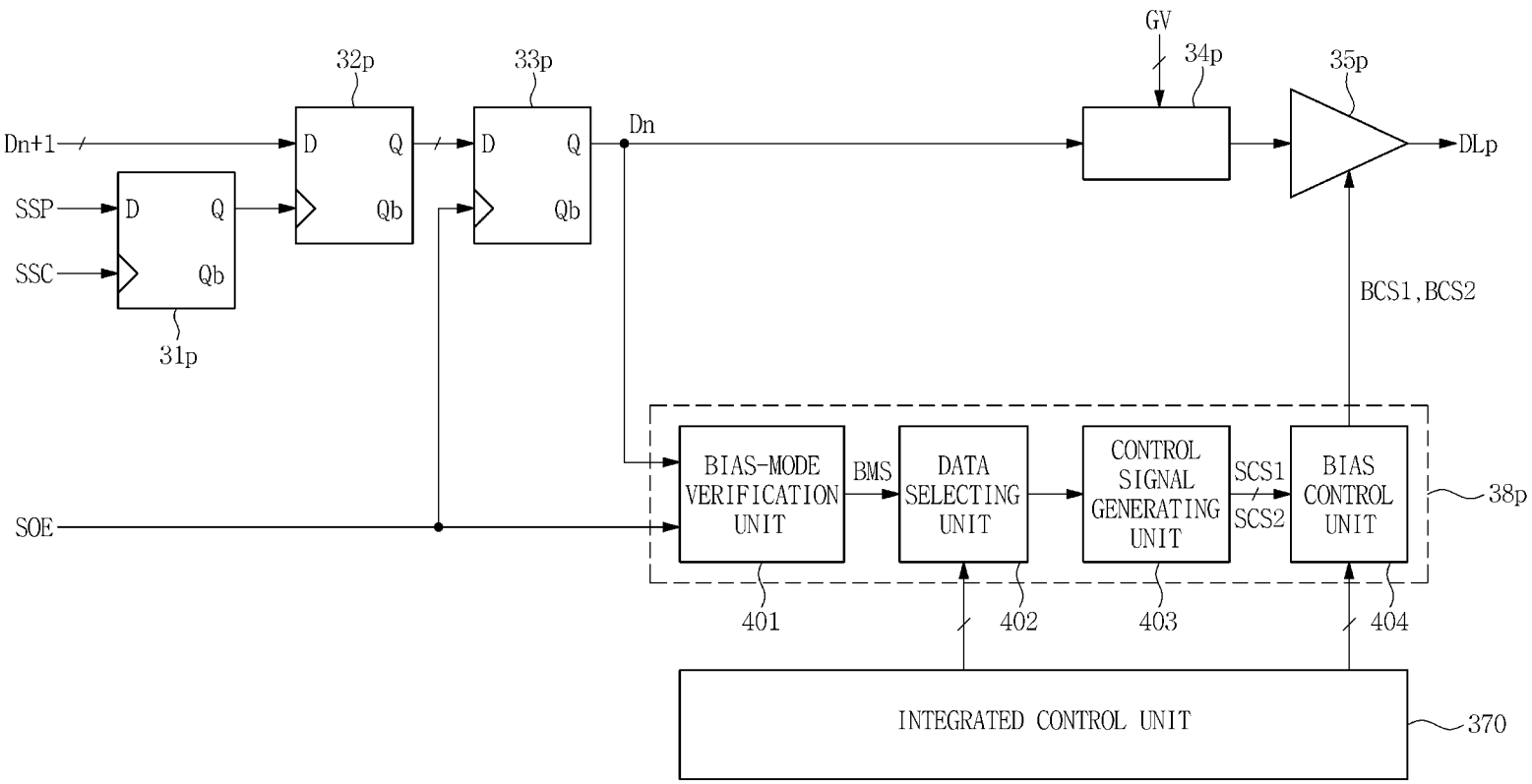
FIG. 4 is a view illustrating elements and an integrated control unit for driving a data line among elements included in the data driver of FIG. 3.
Figure 5:
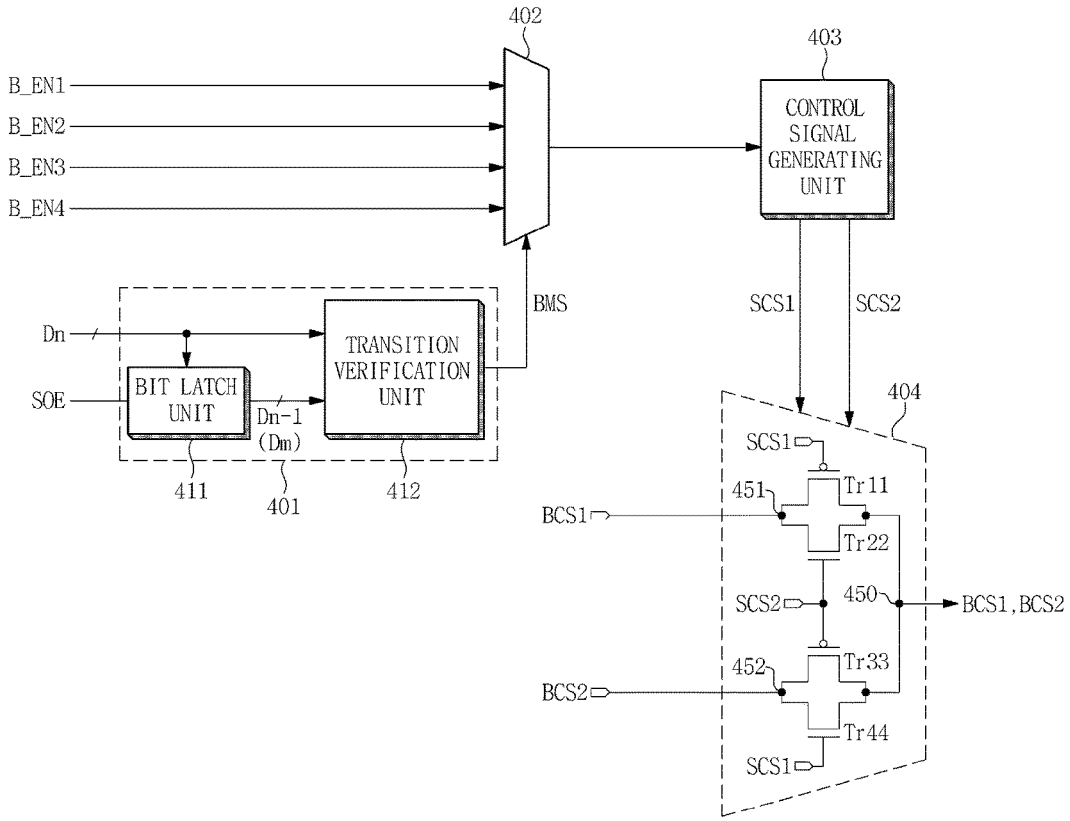
FIG. 5 is a detailed configuration view illustrating a bias-mode verification unit, a data selecting unit, and a bias control unit of FIG. 4.

FIG. 4 is a view illustrating elements and an integrated control unit 370 for driving a data line among elements included in the data driver 111 of FIG. 3. FIG. 5 is a detailed configuration view illustrating a bias-mode verification unit 401, a data selecting unit 402, and a bias control unit 404 of FIG. 4.

A shift register 31*p* illustrated in FIG. 4 is a $p^{th}$ shift register ("p" is one selected from 1 to "j") corresponding to a $p^{th}$ data line DLp from among the "j" number of shift registers 31 included in the shift register unit 310 illustrated in FIG. 3.

A sampling latch 32*p* illustrated in FIG. 4 is a $p^{th}$ sampling latch corresponding to the $p^{th}$ data line DLp from among the "j" number of sampling latches 32 included in the sampling latch unit 320 illustrated in FIG. 3.

A holding latch 33*p* illustrated in FIG. 4 is a $p^{th}$ holding latch corresponding to the $p^{th}$ data line DLp from among the "j" number of holding latches 33 included in the holding latch unit 330 illustrated in FIG. 3.

A digital-analog converter 34*p* illustrated in FIG. 4 is a $p^{th}$ digital-analog converter corresponding to the $p^{th}$ data line DLp from among the "j" number of digital-analog converters 34 included in the digital-analog converting unit 340 illustrated in FIG. 3.

A buffer 35*p* illustrated in FIG. 4 is a $p^{th}$ buffer corresponding to the $p^{th}$ data line DLp from among the "j" number of buffers 35 included in the buffer unit 350 illustrated in FIG. 3.

In addition, a bias adjustor 38*p* illustrated in FIG. 4 is a $p^{th}$ bias adjustor corresponding to the $p^{th}$ data line DLp from among the "j" number of bias adjustors 38 included in the bias adjusting unit 380 illustrated in FIG. 3.

The bias adjustor 38*p*, as illustrated in FIG. 4, includes the bias-mode verification unit 401, the data selecting unit 402, a control signal generating unit 403, and the bias control unit 404.

The bias-mode verification unit 401, as illustrated in FIG. 5, generates a bias-mode signal BMS based on an $n^{th}$ image data signal Dn and an $m^{th}$ image data signal Dm ("m" is a natural number smaller than "n") corresponding to the $p^{th}$ data line DLp.

The $n^{th}$ image data signal Dn and the $m^{th}$ image data signal Dm each are a digital signal, and the $m^{th}$ image data signal Dm is output prior to the $n^{th}$ image data signal Dn being output in time. In other words, the $m^{th}$ image data signal Dm is a former signal as compared to the $n^{th}$ image data signal Dn. In an exemplary embodiment, the $m^{th}$ image data signal Dm may be an $n-1^{th}$ image data signal Dn−1.

The $n^{th}$ image data signal Dn is a digital signal corresponding to an $n^{th}$ analog image data signal to be applied to the $p^{th}$ data line DLp. In addition, the $m^{th}$ image data signal Dm is a digital signal corresponding to an $m^{th}$ analog image data signal to be applied to the $p^{th}$ data line DLp. After the $m^{th}$ analog image data signal is applied to the $p^{th}$ data line DLp, the $n^{th}$ analog image data signal is applied to the $n^{th}$ data line DLp.

Hereinafter, for ease of description, the $m^{th}$ image data signal Dm will be described as being the $n-1^{th}$ image data signal Dn−1 by way of example. However, the $m^{th}$ image data signal Dm is not limited to the $n-1^{th}$ image data signal Dn−1. In an exemplary embodiment, the $m^{th}$ image data signal Dm may be an $n-2^{th}$ image data signal Dn−2, an $n-3^{th}$ image data signal Dn−3, . . . , or an $n-z^{th}$ image data signal Dn−z ("z" is a natural number smaller than "n" and greater than 3), for example.

The bias-mode verification unit 401 compares the $n^{th}$ image data signal Dn to the $n-1^{th}$ image data signal Dn−1 so as to verify an amount of variation between adjacent image data signals, and generates the bias-mode signal BMS as the verification result. To this end, the bias-mode verification unit 401 may generate the bias-mode signal BMS based on a difference value between the $n^{th}$ image data signal Dn and the $n-1^{th}$ image data signal Dn−1. The difference value is an absolute value. The bias-mode signal BMS is a digital signal, and the bias-mode signal BMS has a digital value that varies in accordance with a level of the difference value. That is, the digital value of the bias-mode signal BMS corresponds to a degree by which the $n^{th}$ image data signal Dn, that is, a current image data signal, is increased or decreased, as compared to the $n-1^{th}$ image data signal Dn−1, that is, a former image data signal.

The bias-mode verification unit 401, as illustrated in FIG. 5, may include a bit latch unit 411 and a transition verification unit 412.

The bit latch unit 411 stores the $n^{th}$ image data signal Dn applied from the holding latch 33*p* thereinside and provides, to the transition verification unit 412, the $n-1^{th}$ image data signal Dn−1, which is stored thereinside prior to the $n^{th}$ image data signal Dn being stored, in response to the source output enable signal SOE.

The bit latch unit 411 may selectively store a part of bits instead of storing entire bits included in the image data signal. In an exemplary embodiment, the bit latch unit 411 may store only upper "q" number of bits ("q" is a natural number smaller than "k") of the image data signal, for example. In more detail, in a case where the $n^{th}$ image data signal Dn is a 8-bit digital signal having a code of '11000000' and the $n-1^{th}$ image data signal Dn−1 is a 8-bit digital signal having a code of '10000000,' the bit latch unit 411 may store '11' which corresponds to upper two bits of the $n^{th}$ image data signal Dn and output '10' which corresponds to upper two bits of the $n-1^{th}$ image data signal Dn−1.

The transition verification unit 412 receives the $n-1^{th}$ image data signal Dn−1 from the bit latch unit 411, and also receives the $n^{th}$ image data signal Dn from the holding latch 33*p*. The transition verification unit 412 calculates a difference value between the $n-1^{th}$ image data signal Dn−1 applied from the bit latch unit 411 and the $n^{th}$ image data signal Dn applied from the holding latch 33*p*. The transition verification unit 412 generates the bias-mode signal BMS based on the calculated difference value.

In a case where the bit latch unit 411 stores only a part of bits from the image data signal, the transition verification unit 412 may selectively receive only a part of bits instead of receiving entire bits included in the image data signal. In an exemplary embodiment, the transition verification unit 412 may receive only upper "q" number of bits of the image data signal, for example. In more detail, in a case where the $n^{th}$ image data signal Dn is a 8-bit digital signal having a code of '11000000' and the $n-1^{th}$ image data signal Dn−1 is a 8-bit digital signal having a code of '10000000,' the transition verification unit 412 may receive '11' which corresponds to upper two bits of the $n^{th}$ image data signal Dn from the holding latch 33*p* and also receive '10' which corresponds to upper two bits of the $n-1^{th}$ image data signal Dn−1 from the bit latch unit 411. In this case, the transition verification unit 412 calculates a difference value between a bit signal corresponding to '11' and a bit signal corresponding to '10.' In this case, the difference value is '01,' and the transition verification unit 412 may output a digital signal of '01' as the bias-mode signal BMS. The bias-mode signal BMS output from the transition verification unit 412 is provided to the data selecting unit 402.

So as to allow only a part of bits of the image data signal to be selectively applied to the bit latch unit 411 and the transition verification unit 412 as described in the foregoing, the bit latch unit 411 and the transition verification unit 412 may each include a bit extracting unit. The bit extracting unit only extracts upper "q" number of bits from the image data signal applied from the holding latch 33*p*.

The data selecting unit 402 receives the bias-mode signal BMS from the transition verification unit 412, and receives the plurality of bias enable signals from the integrated control unit 370. The data selecting unit 402 selects one of the plurality of bias enable signals based on the bias-mode signal BMS. In an exemplary embodiment, the data selecting unit 402 may be a multiplexer, for example.

The data selecting unit 402 may receive "$2^q$" number of bias enable signals from the integrated control unit 370. In an exemplary embodiment, in a case where "q" is "2" similar to the foregoing, the data selecting unit 402 receives four bias enable signals B_EN1, B_EN2, B_EN3, and B_EN4 in total, for example.

The plurality of bias enable signals B_EN1, B_EN2, B_EN3, and B_EN4 are a digital signal. At least two of the plurality of bias enable signals B_EN1, B_EN2, B_EN3, and B_EN4 have different duty ratios from each other. In an exemplary embodiment, the first bias enable signal B_EN1 may have a relatively high duty ratio, the second bias enable signal B_EN2 may have a duty ratio lower than that of the first bias enable signal B_EN1, the third bias enable signal B_EN3 may have a duty ratio lower than that of the second bias enable signal B_EN2, and the fourth bias enable signal B_EN4 may have a duty ratio lower than that of the third bias enable signal B_EN3, for example.

The data selecting unit 402 selects one of the plurality of bias enable signals B_EN1, B_EN2, B_EN3, and B_EN4 based on the bias-mode signal BMS, and outputs the selected signal. In an exemplary embodiment, the data selecting unit 402 outputs a first bias enable signal B_EN1 having a highest duty ratio in a case where the bias-mode signal BMS has a digital code of "00," the data selecting unit 402 outputs a second bias enable signal B_EN2 having a second highest duty ratio in a case where the bias-mode signal BMS has a digital code of "01," the data selecting unit 402 outputs a third bias enable signal B_EN3 having a third highest duty ratio in a case where the bias-mode signal BMS has a digital code of "10," and the data selecting unit 402 outputs a fourth bias enable signal B_EN4 having a lowest duty ratio in a case where the bias-mode signal BMS has a digital code of "11," for example.

The bias enable signal selected by the data selecting unit 402 may be applied to the control signal generating unit 403. Accordingly, the data selecting unit 402 may select a bias enable signal having a lower duty ratio, as an amount of variation among the sequentially output image data signals increases. In an alternative exemplary embodiment, however, the data selecting unit 402 may select a bias enable signal having a higher duty ratio, as the amount of variation among the sequentially output image data signals increases.

The control signal generating unit 403 generates a first switching signal SCS1 and a second switching signal SCS2 based on the bias enable signal selected by the data selecting unit 402. In an exemplary embodiment, the control signal generating unit 403 may modulate a level of the selected bias enable signal to thereby generate the first switching control signal SCS1, and may invert a phase of the first switching control signal SCS1 to thereby generate the second switching control signal SCS2, for example. The control signal generating unit 403 may be a level shifter that generates outputs that are inverted from each other.

Figure 6:
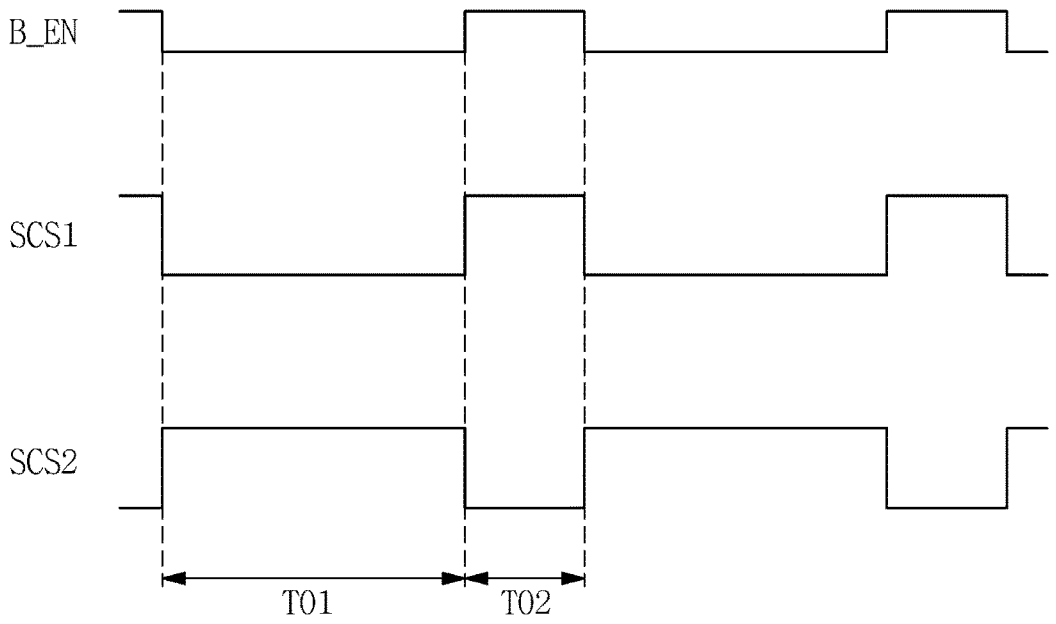
FIG. 6 is a view illustrating waveforms of a selected bias enable signal and switching control signals of FIG. 5.

FIG. 6 is a view illustrating waveforms of the selected bias enable signal and the switching control signals.

The first switching control signal SCS1 and the second switching control signal SCS2 are an analog signal. As illustrated in FIG. 6, the first switching control signal SCS1 has a phase the same as that of the selected bias enable signal B_EN, and has a level greater than that of the selected bias enable signal B_EN.

The first switching control signal SCS1 and the second switching control signal SCS2 are alternating current ("AC") signals respectively having phases opposite to each other. In an exemplary embodiment, as illustrated in FIG. 6, the second switching control signal SCS2 may have a phase inverted by 180 degrees with respect to the phase of the first switching control signal SCS1, for example. Accordingly, in a period T02 in which the first switching control signal SCS1 has a high voltage, the second switching control signal SCS2 has a low voltage, and in a period T01 in which the first switching control signal SCS1 has a low voltage, the second switching control signal SCS2 has a high voltage.

The high voltage of the first switching control signal SCS1 has a level greater than that of the bias enable signal. Likewise, the high voltage of the second switching control signal SCS2 has a level greater than that of the bias enable signal. In addition, the low voltage of the first switching control signal SCS1 has a level less than that of the bias enable signal. Likewise, the low voltage of the second switching control signal SCS2 has a level less than that of the bias enable signal.

The first switching control signal SCS1 and the second switching control signal SCS2 define an output period of a first bias control signal BCS1 and a second bias control signal BCS2 to be described below. Herein, the output period includes a first output period T01 and a second output period T02.

The first output period T01 corresponds to a low period of the first switching control signal SCS1 and a high period of the second switching control signal SCS2. The second output period T02 corresponds to a high period of the first switching control signal SCS1 and a low period of the second switching control signal SCS2. The first switching control signal SCS1 maintains the low voltage in the low period of the first switching control signal SCS1, and the first switching control signal SCS1 maintains the high voltage in the high period of the first switching control signal SCS1. The second switching control signal SCS2 maintains the low voltage in the low period of the second switching control signal SCS2, and the second switching control signal SCS2 maintains the high voltage in the high period of the second switching control signal SCS2.

The first switching control signal SCS1 and the second switching control signal SCS2 output from the control signal generating unit 403 are provided to the bias control unit 404 (refer to FIG. 5).

Referring to FIGS. 4 to 6, the bias control unit 404 receives the first switching control signal SCS1 and the second switching control signal SCS2 from the control signal generating unit 403, and receives the first bias control signal BCS1 and the second bias control signal BCS2 from the integrated control unit 370.

The bias control unit 404 selects one of the first bias control signal BCS1 and the second bias control signal BCS2 in the first output period T01 and the second output period T02 defined by the first switching control signal SCS1 and the second switching control signal SCS2, and applies the selected bias control signal to the buffer 35*p*. In an exemplary embodiment, the bias control unit 404 may select the first bias control signal BCS1 to output the first bias control signal BCS1 in the first output period T01, and selects the second bias control signal BCS2 to output the second bias control signal BCS2 in the second output period T02, for example. In an exemplary embodiment, the bias control unit 404 may be a multiplexer, for example.

In an exemplary embodiment, the first bias control signal BCS1 and the second bias control signal BCS2 are an analog signal, for example. However, the invention is not limited thereto, and the first bias control signal BCS1 and the second bias control signal BCS2 may be a DC voltage, for example. In an alternative exemplary embodiment, the first bias control signal BCS1 and the second bias control signal BCS2 may be a DC current. The first bias control signal BCS1 and the second bias control signal BCS2 have levels different from each other. In an exemplary embodiment, the second bias control signal BCS2 may have a level less than that of the first bias control signal BCS1. In an exemplary embodiment, the second bias control signal BCS2 may have a level that is about 60 percent (%) of the level of the first bias control signal BCS1, for example.

The first bias control signal BCS1 and the second bias control signal BCS2 output from the bias control unit 404 are applied to the buffer 35*p*. In this case, the first bias control signal BCS1 and the second bias control signal BCS2 may be sequentially input to the buffer 35*p*. In an exemplary embodiment, the first bias control signal BCS1 is input to the buffer 35*p* in the first output period T01, and subsequently, the second bias control signal BCS2 is input to the buffer 35*p* in the second output period T02, for example.

The length of the first output period T01 corresponds to the length of the low period of the first switching control signal SCS1 or the length of the high period of the second switching control signal SCS2. As the length of the low period of the first switching control signal SCS1 or the length of the high period of the second switching control signal SCS2 correspond to the length of the low period of the selected bias enable signal B_EN, a time period for which the first bias control signal BCS1 is applied to the buffer 35*p* is controlled by the duty ratio of the selected bias enable signal B_EN. In an exemplary embodiment, as the duty ratio of the selected bias enable signal B_EN decreases, the first bias control signal BCS1 may be applied to the buffer 35*p* for a longer time period, for example.

The length of the second output period T02 corresponds to the length of the high period of the first switching control signal SCS1 or the length of the low period of the second switching control signal SCS2. As the length of the high period of the first switching control signal SCS1 or the length of the low period of the second switching control signal SCS2 correspond to the length of the high period of the selected bias enable signal B_EN, a time period for which the second bias control signal BCS2 is applied to the buffer 35*p* is controlled by the duty ratio of the selected bias enable signal B_EN. In an exemplary embodiment, as the duty ratio of the selected bias enable signal B_EN increases, the second bias control signal BCS2 may be applied to the buffer 35*p* for a longer time period, for example.

Accordingly, as the duty ratio of the selected bias enable signal B_EN decreases, the time period for which the first bias control signal BCS1 is applied increases, whereas the time period for which the second bias control signal BCS2 is applied decreases. On the contrary, as the duty ratio of the selected bias enable signal B_EN increases, the time period for which the first bias control signal BCS1 is applied decreases, whereas the time period for which the second bias control signal BCS2 is applied increases.

The bias control unit 404, as illustrated in FIG. 5, may include a first input terminal 451 to which the first bias control signal BCS1 is input from the integrated control unit 370, a second input terminal 452 to which the second bias control signal BCS2 is input from the integrated control unit 370, an output terminal 450 connected to the buffer 35*p*, a p-type first switching element Tr11, an n-type second switching element Tr22, a p-type third switching element Tr33, and an n-type fourth switching element Tr44.

The p-type first switching element Tr11 is controlled by the first switching control signal SCS1, and is connected between the first input terminal 451 and the output terminal 450. The p-type first switching element Tr11 is turned on or turned off by the first switching control signal SCS1, and when being turned on, the p-type first switching element Tr11 outputs the first bias control signal BCS1 to the output terminal 450.

The n-type second switching element Tr22 is controlled by the second switching control signal SCS2, and is connected between the first input terminal 451 and the output terminal 450. The n-type second switching element Tr22 is turned on or turned off by the second switching control signal SCS2, and when being turned on, the n-type second switching element Tr22 outputs the first bias control signal BCS1 to the output terminal 450.

The p-type third switching element Tr33 is controlled by the second switching control signal SCS2, and is connected between the second input terminal 452 and the output terminal 450. The p-type third switching element Tr33 is turned on or turned off by the second switching control signal SCS2, and when being turned on, the p-type third switching element Tr33 outputs the second bias control signal BCS2 to the output terminal 450.

The n-type fourth switching element Tr44 is controlled by the first switching control signal SCS1, and is connected between the second input terminal 452 and the output terminal 450. The n-type fourth switching element Tr44 is turned on or turned off by the first switching control signal SCS1, and when being turned on, the n-type fourth switching element Tr44 outputs the second bias control signal BCS2 to the output terminal 450.

The p-type first switching element Tr11 and the n-type second switching element Tr22 constitute a transmission gate element as a pair, and the p-type third switching element Tr33 and the n-type fourth switching element Tr44 constitute another transmission gate element as a pair.

The high voltage of the first switching control signal SCS1 has a level that may turn on the n-type second switching element Tr22 and the n-type fourth switching element Tr44, and the low voltage of the first switching control signal SCS1 has a level that may turn on the p-type first switching element Tr11 and the p-type third switching element Tr33. The high voltage of the second switching control signal SCS2 has a level that may turn on the n-type second switching element Tr22 and the n-type fourth switching element Tr44, and the low voltage of the second switching control signal SCS2 has a level that may turn on the p-type first switching element Tr11 and the p-type third switching element Tr33.

In a case where the first switching control signal SCS1 has the low voltage and the second switching control signal SCS2 has the high voltage in the first output period T01, each of the first switching element Tr11 and the second switching element Tr22 connected as a pair is turned on. On the contrary, each of the third switching element Tr33 and the fourth switching element Tr44 connected as another pair is turned off. Accordingly, in the first output period T01, the first bias control signal BCS1 is applied to the buffer 35*p* through the first switching element Tr11 and the second switching element Tr22 that are turned on.

In a case where the first switching control signal SCS1 has the high voltage and the second switching control signal SCS2 has the low voltage in the second output period T02, each of the first switching element Tr11 and the second switching element Tr22 connected as a pair is turned off. On the contrary, each of the third switching element Tr33 and the fourth switching element Tr44 connected as another pair is turned on. Accordingly, in the second output period T02, the second bias control signal BCS2 is applied to the buffer 35*p* through the third switching element Tr33 and the fourth switching element Tr44 that are turned on.

The buffer 35*p* generates a bias current based on the first bias control signal BCS1 and the second bias control signal BCS2, and amplifies the analog image data signal using the bias current. To this end, the buffer 35*p* may include a bias end, an input end, and an output end.

The bias end of the buffer 35*p* may include at least one current source. The bias end controls a level of the bias current generated from the current source in response to the first bias control signal BCS1 and the second bias control signal BCS2. In an exemplary embodiment, the bias end may output the first bias current based on the first bias control signal BCS1, and may output the second bias current based on the second bias control signal BCS2, for example. The second bias current is less than the first bias current.

The input end of the buffer 35*p* amplifies the analog image data signal input to an inverting terminal and a non-inverting terminal of the buffer 35*p* based on the bias current applied from the bias end to thereby output the amplified analog image data signal.

The output end of the buffer 35*p* amplifies the analog image data signal applied from the input end to output the amplified analog image data signal to the $p^{th}$ data line DLp. In an exemplary embodiment, the buffer 35*p* may be an operational amplifier, for example.

Figure 7:
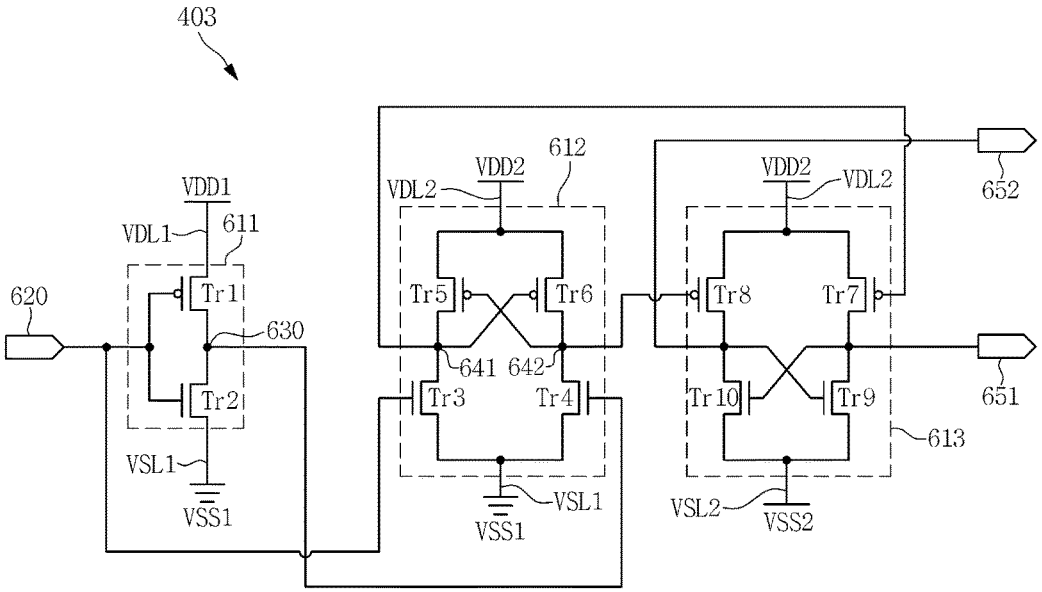
FIG. 7 is a detailed configuration view illustrating a control signal generating unit of FIG. 5.

FIG. 7 is a detailed configuration view illustrating the control signal generating unit 403 of FIG. 5.

As described in the foregoing, the control signal generating unit 403 may be a level shifter that generates two outputs that are inverted from each other. The control signal generating unit 403, as illustrated in FIG. 7, includes an input terminal 620 to which the bias enable signal is applied from the data selecting unit 402, a first output terminal 651 to which the first switching control signal SCS1 is output, a second output terminal 652 to which the second switching control signal SCS2 is output, an inverting unit 611, an intermediate control unit 612, and an output unit 613.

The inverting unit 611 generates an inverted bias enable signal based on the bias enable signal applied to the input terminal 620. To this end, the inverting unit 611 may include a p-type first switching element Tr1 and an n-type second switching element Tr2.

The p-type first switching element Tr1 is controlled by the bias enable signal applied from the input terminal 620, and is connected between a first high-voltage power line VDL1 and an inverting terminal 630. The first high-voltage power line VDL1 transmits a first high voltage VDD1. The first high voltage VDD1 is an analog signal, and a DC voltage, for example. The p-type first switching element Tr1 is turned on or turned off by the bias enable signal applied from the input terminal 620, and when being turned on, the p-type first switching element Tr1 outputs the first high voltage VDD1 to the inverting terminal 630.

The n-type second switching element Tr2 is controlled by the bias enable signal applied from the input terminal 620, and is connected between the inverting terminal 630 and a first low-voltage power line VSL1. The first low-voltage power line VSL1 transmits a first low voltage VSS1. The first low voltage VSS1 may be a ground voltage. The n-type second switching element Tr2 is turned on or turned off by the bias enable signal applied from the input terminal 620, and when being turned on, the n-type second switching element Tr2 outputs the first low voltage VSS1 to the inverting terminal 630.

The intermediate control unit 612 generates a first intermediate control signal and a second intermediate control signal based on the bias enable signal applied from the data selecting unit 402 and the inverted bias enable signal applied from the inverting unit 611. To this end, the intermediate control unit 612 may include an n-type third switching element Tr3, an n-type fourth switching element Tr4, a p-type fifth switching element Tr5, and a p-type sixth switching element Tr6.

The n-type third switching element Tr3 is controlled by the bias enable signal applied from the input terminal 620, and is connected between the first intermediate terminal 641 and the first low-voltage power line VSL1. The n-type third switching element Tr3 is turned on or turned off by the bias enable signal applied from the input terminal 620 and when being turned on, the n-type third switching element Tr3 outputs the first low voltage VSS1 to the first intermediate terminal 641.

The n-type fourth switching element Tr4 is controlled by the inverted bias enable signal applied from the inverting terminal 630, and is connected between a second intermediate terminal 642 and the first low-voltage power line VSL1. The n-type fourth switching element Tr4 is turned on or turned off by the inverted bias enable signal applied from the inverting terminal 630 and when being turned on, the n-type fourth switching element Tr4 outputs the first low voltage VSS1 to the second intermediate terminal 642.

The p-type fifth switching element Tr5 is controlled by the second intermediate control signal applied from the second intermediate terminal 642, and is connected between a second high-voltage power line VDL2 and the first intermediate terminal 641. The second high-voltage power line VDL2 transmits a second high voltage VDD2. The second high voltage VDD2 is an analog voltage, and is greater than the first high voltage VDD1. The p-type fifth switching element Tr5 is turned on or turned off by the second intermediate control signal applied from the second intermediate terminal 642, and when being turned on, the p-type fifth switching element Tr5 outputs the second high voltage VDD2 to the first intermediate terminal 641.

The p-type sixth switching element Tr6 is controlled by the first intermediate control signal applied from the first intermediate terminal 641, and is connected between the second high-voltage power line VDL2 and the second intermediate terminal 642. The p-type sixth switching element Tr6 is turned on or turned off by the first intermediate control signal applied from the first intermediate terminal 641 and when being turned on, the p-type sixth switching element Tr6 outputs the second high voltage VDD2 to the second intermediate terminal 642.

The output unit 613 generates the first switching control signal SCS1 and the second switching control signal SCS2 based on the first intermediate control signal and the second intermediate control signal applied from the intermediate control unit 612, and outputs the generated first switching control signal SCS1 and the generated second switching control signal SCS2 to the first output terminal 651 and the second output terminal 652, respectively. To this end, the output unit 613 includes a p-type seventh switching element Tr7, a p-type eighth switching element Tr8, an n-type ninth switching element Tr9, and an n-type tenth switching element Tr10.

The p-type seventh switching element Tr7 is controlled by the first intermediate control signal applied from the first intermediate terminal 641, and is connected between the second high-voltage power line VDL2 and the first output terminal 651. The p-type seventh switching element Tr7 is turned on or turned off by the first intermediate control signal applied from the first intermediate terminal 641 and when being turned on, the p-type seventh switching element Tr7 outputs the second high voltage VDD2 to the first output terminal 651.

The p-type eighth switching element Tr8 is controlled by the second intermediate control signal applied from the second intermediate terminal 642, and is connected between the second high-voltage power line VDL2 and the second output terminal 652. The p-type eighth switching element Tr8 is turned on or turned off by the second intermediate control signal applied from the second intermediate terminal 642 and when being turned on, the p-type eighth switching element Tr8 outputs the second high voltage VDD2 to the second output terminal 652.

The n-type ninth switching element Tr9 is controlled by the second switching control signal SCS2 applied from the second output terminal 652, and is connected between the first output terminal 651 and a second low-voltage power line VSL2. The second low-voltage power line VSL 2 transmits a second low voltage VSS2. The second low voltage VSS2 is an analog signal, and is less than the first low voltage VSS1. The n-type ninth switching element Tr9 is turned on or turned off by the second switching control signal SCS2 applied from the second output terminal 652 and when being turned on, the n-type ninth switching element Tr9 outputs the second low voltage VSS2 to the first output terminal 651.

The n-type tenth switching element Tr10 is controlled by the first switching control signal SCS1 applied from the first output terminal 651, and is connected between the second output terminal 652 and the second low-voltage power line VSL2. The n-type tenth switching element Tr10 is turned on or turned off by the first switching control signal SCS1 applied from the first output terminal 651 and when being turned on, the n-type tenth switching element Tr10 outputs the second low voltage VSS2 to the second output terminal 652.

The high voltage of the first switching control signal SCS1 output through the first output terminal 651 of the output unit 613 is the same as the second high voltage VDD2, and the low voltage of the first switching control signal SCS1 output therethrough is the same as the second low voltage VSS2.

The high voltage of the second switching control signal SCS2 output through the second output terminal 652 of the output unit 613 is the same as the second high voltage VDD2, and the low voltage of the second switching control signal SCS2 output therethrough is the same as the second low voltage VSS2.

Figure 8:
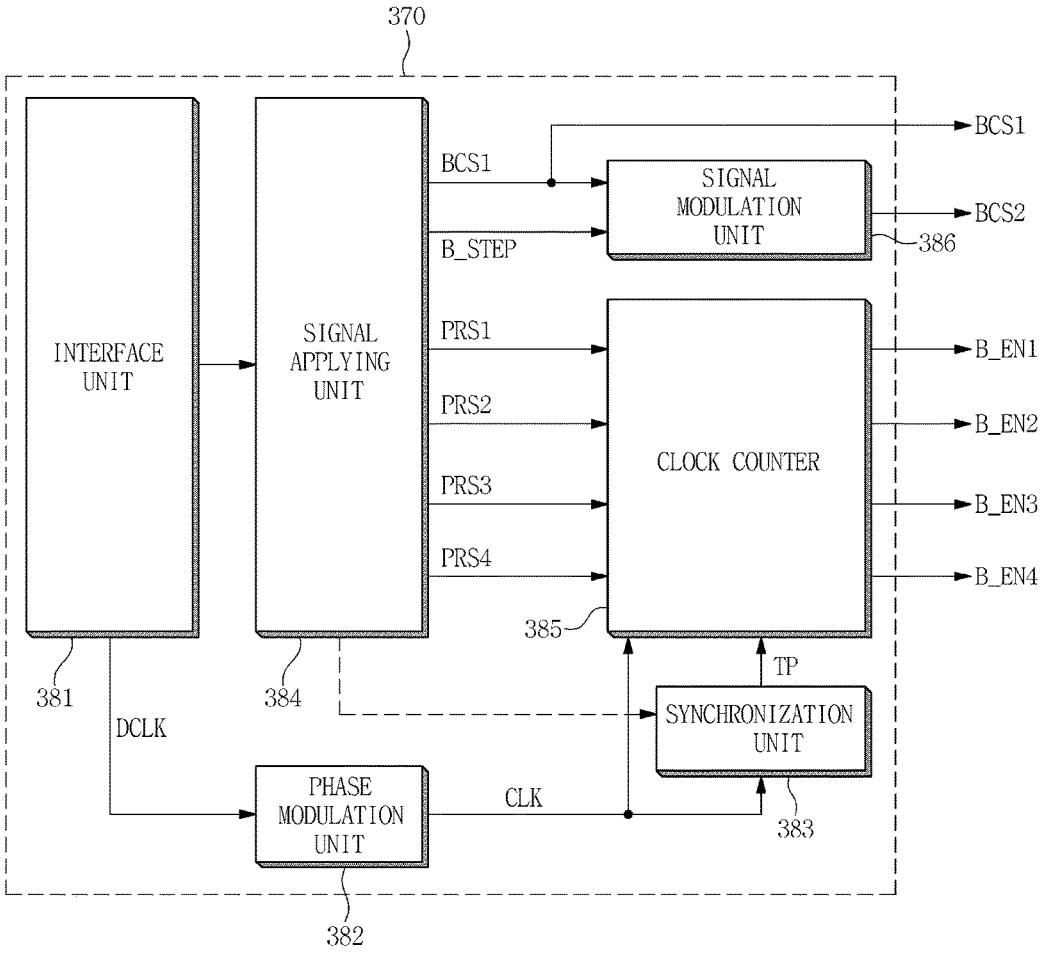
FIG. 8 is a detailed configuration view illustrating the integrated control unit of FIG. 4.

FIG. 8 is a detailed configuration view illustrating the integrated control unit 370 of FIG. 4.

The integrated control unit 370, as illustrated in FIG. 8, includes a signal applying unit 384, a signal modulation unit 386, a clock counter 385, an interface unit 381, a phase modulation unit 382, and a synchronization unit 383.

The signal applying unit 384 receives various signals from the timing controller 101 through the interface unit 381 and generate the first bias control signal BCS1, a bias level control signal B_STEP, and a plurality of parameter signals PRS1, PRS2, PRS3, and PRS4.

The phase modulation unit 382 receives the reference clock signal DCLK from the timing controller 101 through the interface unit 381 and shift the phase of the reference clock signal DCLK to output a clock signal CLK having a shifted phase. The clock signal CLK output from the phase modulation unit 382 has a phase that leads the phase of the reference clock signal DCLK. The phase modulation unit 382 may be a delay locked loop DLL.

The signal modulation unit 386 generates the second bias control signal BCS2 based on the first bias control signal BCS1 and the bias level control signal B_STEP applied from the signal applying unit 384. The signal modulation unit 386 subtracts the bias level control signal B_STEP from the first bias control signal BCS1 to thereby generate the second bias control signal BCS2. The second bias control signal BCS2 generated in the signal modulation unit 386, for example, may have a level that is about 60% of the level of the first bias control signal BCS1.

The synchronization unit 383 receives the clock signal CLK from the phase modulation unit 382 and generates an output control signal TP. In this case, the synchronization unit 383 may be controlled by the signal applying unit 384 to apply the output control signal TP to the clock counter 385. The output control signal TP may have a phase that leads the phase of the source output enable signal SOE. In an alternative exemplary embodiment, the output control signal TP may have a phase the same as the phase of the source output enable signal SOE.

The clock counter 385 generates a plurality of bias enable signals B_EN1, B_EN2, B_EN3, and B_EN4 based on the plurality of parameter signals PRS1, PRS2, RPS3, and PRS4 applied from the signal applying unit 384 and the clock signal CLK applied from the phase modulation unit 382.

The parameter signals PRS1, PRS2, RPS3, and PRS4 include information on a start point in time of the respective bias enable signals B_EN1, B_EN2, B_EN3, and B_EN4 and information on an end point in time of the respective bias enable signals B_EN1, B_EN2, B_EN3, and B_EN4, respectively. The start points in time included in the respective parameter signals PRS1, PRS2, RPS3, and PRS4 may be the same as or different from one another. In addition, the end points in time included in the respective parameter signals PRS1, PRS2, RPS3, and PRS4 may be different from one another. However, in a case where the start points in time included in the respective parameter signals PRS1, PRS2, RPS3, and PRS4 are the same as one another, the end points in time included in the respective parameter signals PRS1, PRS2, RPS3, and PRS4 are different from one another. In a case where the end points in time included in the respective parameter signals PRS1, PRS2, RPS3, and PRS4 are the same as one another, the start points in time included in the respective parameter signals PRS1, PRS2, RPS3, and PRS4 are different from one another.

The clock counter 385 generates "2q" number of bias enable signals. In an exemplary embodiment, the clock counter 385, as illustrated in FIG. 8, may generate four bias enable signals B_EN1, B_EN2, B_EN3, and B_EN4, for example. The clock counter 385 generates the first bias enable signal B_EN1 based on the first parameter signal PRS1 and the clock signal CLK, the second bias enable signal B_EN2 based on the second parameter signal PRS2 and the clock signal CLK, the third bias enable signal B_EN3 based on the third parameter signal PRS3 and the clock signal CLK, and the fourth bias enable signal B_EN4 based on the fourth parameter signal PRS4 and the clock signal CLK. Herein, the clock counter 385 generates the first bias enable signal B_EN1 in a method described below.

The clock counter 385 counts the clock signals CLK. At each counting point in time, the clock counter 385 compares a count value at the counting point in time and the start point in time included in the first parameter signal PRS1, and compares the count value and the end point in time included in the first parameter signal PRS1. In this case, the clock counter 385 generates a high output from a point in time at which the count value corresponds to the start point in time. Subsequently, the clock counter 385 carries on counting the clock signals CLK, and generates a low output from a point in time at which the count value corresponds to the end point in time. In this case, the clock counter 385 is reset from the point in time at which the low output is generated so as to start counting the clock signals CLK again from the beginning. Accordingly, the first bias enable signal B_EN1 maintaining a high state from a start point in time to an end point in time included in the first parameter signal RPS1 and maintaining a low state from the end point in time to a succeeding start point in time is generated. The other second, third, and fourth bias enable signals B_EN2, B_EN3, and B_EN4 are generated in the same method described in the foregoing.

The clock counter 385 applies the first, second, third, and fourth bias enable signals B_EN1, B_EN2, B_EN3, and B_EN4 simultaneously to the data selecting unit 402 in response to the output control signal TP applied from the synchronization unit 383.

Figure 9:
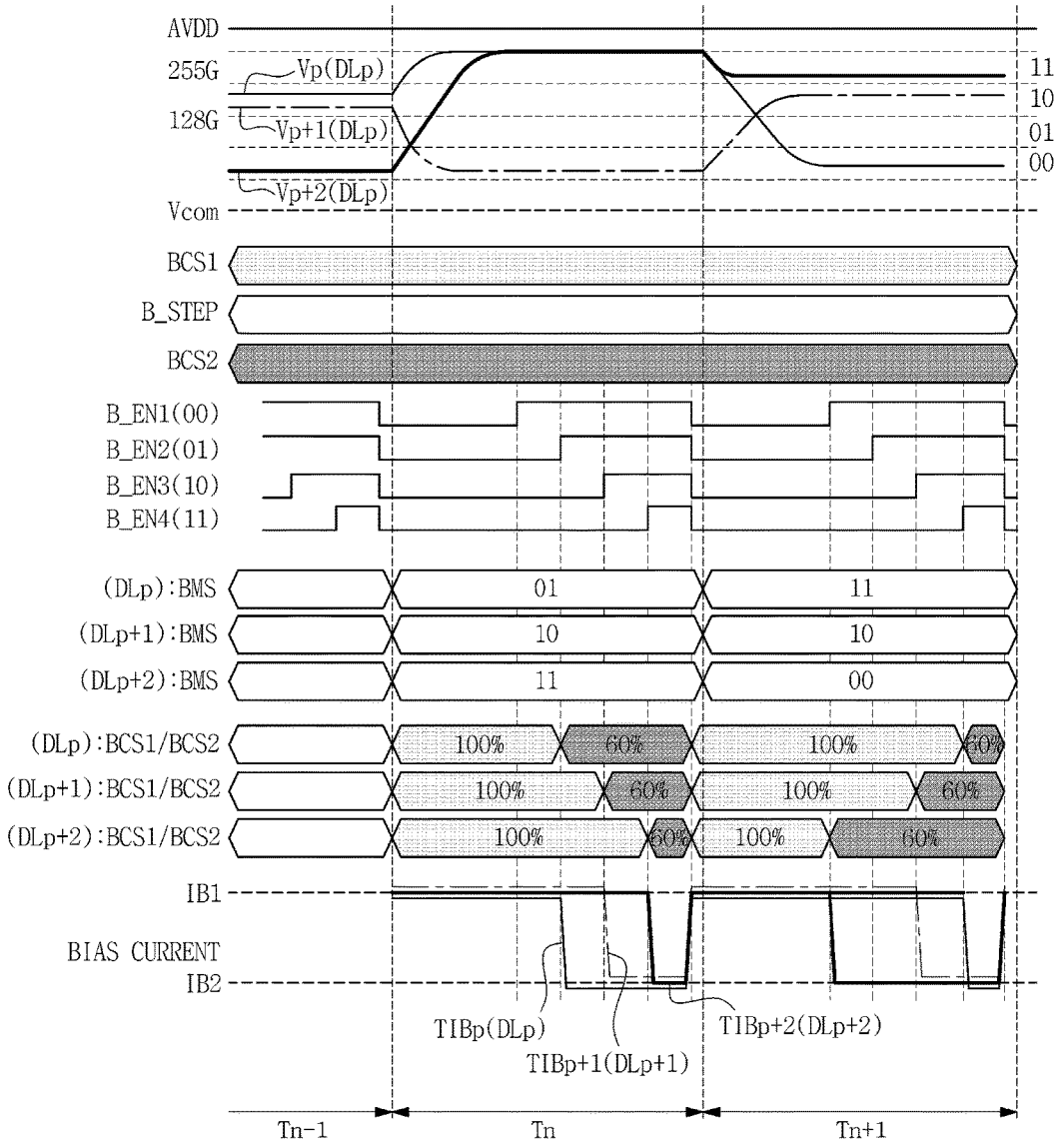
FIG. 9 is a view illustrating an operation of buffers connected to adjacent data lines.

FIG. 9 is a view illustrating an operation of buffers 35 (refer to FIG. 3) connected to adjacent data lines.

Firstly, image data signals corresponding to the $p^{th}$ data line DLp and an operation of the buffer 35*p* (refer to FIG. 4) corresponding to the $p^{th}$ data line DLp will be described.

The $p^{th}$ data driving signal Vp is a signal applied to the $p^{th}$ data line DLp, and includes an $n-1^{th}$ analog image data signal applied to the $p^{th}$ data line DLp in an $n-1^{th}$ display period Tn−1, an $n^{th}$ analog image data signal applied to the $p^{th}$ data line DLp in an $n^{th}$ display period Tn, and an $n+1^{th}$ analog image data signal applied to the $p^{th}$ data line DLp in an $n+1^{th}$ display period Tn+1.

The $n-1^{th}$ analog image data signal, the $n^{th}$ analog image data signal, and the $n+1^{th}$ analog image data signal included in the $p^{th}$ data driving signal Vp are a positive-polarity signal having a level greater than that of the common voltage Vcom and less than that of a reference voltage AVDD. The $n-1^{th}$ analog image data signal, the $n^{th}$ analog image data signal, and the $n+1^{th}$ analog image data signal each have a gray voltage in a range of level 0 (0G) to level 255 (255G), for example. Herein, the term "128G" refers to a gray voltage of level 128.

The $n-1^{th}$ analog image data signal included in the $p^{th}$ data driving signal Vp is a signal generated based on the $n-1^{th}$ digital image data signal Dn−1, the $n^{th}$ analog image data signal included in the $p^{th}$ data driving signal Vp is a signal generated based on the $n^{th}$ digital image data signal Dn, and the $n+1^{th}$ analog image data signal included in the $p^{th}$ data driving signal Vp is a signal generated based on the $n+1^{th}$ digital image data signal Dn+1.

In an exemplary embodiment, the $n-1^{th}$ digital image data signal included in the $p^{th}$ data driving signal Vp is a 8-bit signal having a digital code of '10xxxxxx,' the $n^{th}$ digital image data signal included in the $p^{th}$ data driving signal Vp is a 8-bit signal having a digital code of '11xxxxxx,' and the $n+1^{th}$ digital image data signal included in the $p^{th}$ data driving signal Vp is a 8-bit signal having a digital code of '00xxxxxx,' for example As used herein, "x" is either 0 or 1.

Herein, an operation of the buffer 35*p* corresponding to the $p^{th}$ data line DLp in the $n^{th}$ display period Tn will be described hereinbelow.

A difference between upper two bits of '10' in the $n-1^{th}$ digital image data signal included in the $p^{th}$ data driving signal Vp and upper two bits of '11' in the $n^{th}$ digital image data signal included in the $n^{th}$ data driving signal is '01.' Accordingly, a bias-mode signal BMS having a digital code of '01' is output from the bias-mode verification unit 401 (refer to FIG. 5) corresponding to the $p^{th}$ data line DLp. In this case, the data selecting unit corresponding to the $p^{th}$ data line DLp selects the second bias enable signal B_EN2 in response to the bias-mode signal BMS of '01.' In this case, the first bias control signal BCS1 is input to the $p^{th}$ buffer 35*p* in a low period (first output period) of the second bias enable signal B_EN2, and the second bias control signal BCS2 is input to the $p^{th}$ buffer 35*p* in a high period (second output period) of the second bias enable signal B_EN2. Accordingly, the $p^{th}$ buffer 35*p* performs amplification using the first bias current IB1 in the low period of the second bias enable signal B_EN2, and performs amplification using the second bias current IB2 that is less than the first bias current IB1 in the high period of the second bias enable signal B_EN2. Accordingly, a total bias current TIBp used by the $p^{th}$ buffer 35*p* in the $n^{th}$ display period Tn has a level of the first bias current IB1 in the low period of the second bias enable signal B_EN2, and has a level of the second bias current IB2 in the high period of the second bias enable signal B_EN2.

Hereinafter, an operation of the $p^{th}$ buffer 35*p* in the $n+1^{th}$ display period Tn+1 will be described.

A difference between upper two bits of '11' in the $n^{th}$ digital image data signal included in the $p^{th}$ data driving signal Vp and upper two bits of '00' in the $n+1^{th}$ digital image data signal included in the $p^{th}$ data driving signal is '11.' Accordingly, a bias-mode signal BMS having a digital code of '11' is output from the bias-mode verification unit 401 corresponding to the $p^{th}$ data line DLp. In this case, the data selecting unit 402 corresponding to the $p^{th}$ data line DLp selects the fourth bias enable signal B_EN4 in response to the bias-mode signal BMS of 'H.' In this case, the first bias control signal BCS1 is input to the $p^{th}$ buffer 35*p* in a low period (first output period) of the fourth bias enable signal B_EN4, and the second bias control signal BCS2 is input to the $p^{th}$ buffer 35*p* in a high period (second output period) of the fourth bias enable signal B_EN4. Accordingly, the $p^{th}$ buffer 35*p* performs amplification using the first bias current IB1 in the low period of the fourth bias enable signal B_EN4, and performs amplification using the second bias current IB2 in the high period of the fourth bias enable signal B_EN4. Accordingly, a total bias current TIBp used by the $p^{th}$ buffer 35*p* in the $n+1^{th}$ display period Tn+1 has a level of the first bias current IB1 in the low period of the fourth bias enable signal B_EN4, and has a level of the second bias current IB2 in the high period of the fourth bias enable signal B_EN4.

Herein, since an amount of variation of the image data signal is greater in the $n+1^{th}$ display period Tn+1 than an amount of variation of the image data signal in the $n^{th}$ display period Tn, a data enable signal having a relatively small duty ratio is selected in the $n+1^{th}$ display period Tn_1 as compared to a duty ratio of a data enable signal selected in the $n^{th}$ display period Tn, such that the second bias current IB2 is applied to the $p^{th}$ buffer 35*p* for a shorter period of time in the $n+1^{th}$ display period Tn+1 than a period of time for which the second bias enable current IB2 is applied in the $n^{th}$ display period Tn.

Next, image data signals corresponding to a $p+1^{th}$ data line and an operation of a buffer corresponding to the $p+1^{th}$ data line will be described.

The $p+1^{th}$ data driving signal Vp+1 is a signal applied to the $p+1^{th}$ data line, and includes an $n-1^{th}$ analog image data signal applied to the $p+1^{th}$ data line in an $n-1^{th}$ display period Tn−1, an $n^{th}$ analog image data signal applied to the $p+1^{th}$ data line in an $n^{th}$ display period Tn, and an $n+1^{th}$ analog image data signal applied to the $p+1^{th}$ data line in an $n+1^{th}$ display period Tn+1.

The $n-1^{th}$ analog image data signal, the $n^{th}$ analog image data signal, and the $n+1^{th}$ analog image data signal included in the $p+1^{th}$ data driving signal Vp+1 are a positive-polarity signal having a level greater than that of the common voltage Vcom and less than that of the reference voltage AVDD. The $n-1^{th}$ analog image data signal, the $n^{th}$ analog image data signal, and the $n+1^{th}$ analog image data signal each have a gray voltage in a range of level 0 (0G) to level 255 (255G). Here, the term "128G" refers to a gray voltage of level 128.

The $n-1^{th}$ analog image data signal included in the $p+1^{th}$ data driving signal Vp+1 is a signal generated based on the $n-1^{th}$ digital image data signal, the $n^{th}$ analog image data signal included in the $p+1^{th}$ data driving signal Vp+1 is a signal generated based on the $n^{th}$ digital image data signal, and the $n+1^{th}$ analog image data signal included in the $p+1^{th}$ data driving signal Vp+1 is a signal generated based on the $n+1^{th}$ digital image data signal.

The $n-1^{th}$ digital image data signal included in the $p+1^{th}$ data driving signal Vp+1 is a 8-bit signal having a digital code of '10xxxxxx,' the $n^{th}$ digital image data signal included in the $p+1^{th}$ data driving signal Vp+1 is a 8-bit signal having a digital code of '00xxxxxx,' and the $n+1^{th}$ digital image data signal included in the $p+1^{th}$ data driving signal Vp+1 is a 8-bit signal having a digital code of '10xxxxxx.' As used herein, "x" is either 0 or 1.

Herein, an operation of the buffer corresponding to the $p+1^{th}$ data line (hereinafter, "$p+1^{th}$ buffer") in the $n^{th}$ display period Tn will be described hereinbelow.

A difference between upper two bits of '10' in the $n-1^{th}$ digital image data signal included in the $p+1^{th}$ data driving signal Vp+1 and upper two bits of '00' in the $n^{th}$ digital image data signal included in the $p+1^{th}$ data driving signal is '10.' Accordingly, a bias-mode signal BMS having a digital code of '10' is output from the bias-mode verification unit 401 corresponding to the $p+1^{th}$ data line. In this case, the data selecting unit 402 corresponding to the $p+1^{th}$ data line selects the third bias enable signal B_EN3 in response to the bias-mode signal BMS of '10.' In this case, the first bias control signal BCS1 is input to the $p+1^{th}$ buffer in a low period (first output period) of the third bias enable signal B_EN3, and the second bias control signal BCS2 is input to the $p+1^{th}$ buffer in a high period (second output period) of the third bias enable signal B_EN3. Accordingly, the $p+1^{th}$ buffer performs amplification using the first bias current IB1 in the low period of the third bias enable signal B_EN3, and performs amplification using the second bias current IB2 that is less than the first bias current IB1 in the high period of the third bias enable signal B_EN3. Accordingly, a total bias current TIBp+1 used by the $p+1^{th}$ buffer in the $n^{th}$ display period Tn has a level of the first bias current IB1 in the low period of the third bias enable signal B_EN3, and has a level of the second bias current IB2 in the high period of the third bias enable signal B_EN3.

Hereinafter, an operation of the $p+1^{th}$ buffer in the $n+1^{th}$ display period Tn+1 will be described.

A difference between upper two bits of '00' in the $n^{th}$ digital image data signal included in the $p+1^{th}$ data driving signal Vp+1 and upper two bits of '10' in the $n+1^{th}$ digital image data signal included in the $p+1^{th}$ data driving signal is '10.' Accordingly, a bias-mode signal BMS having a digital code of '10' is output from the bias-mode verification unit 401 corresponding to the $p+1^{th}$ data line. In this case, the data selecting unit 402 corresponding to the $p+1^{th}$ data line selects the third bias enable signal B_EN3 in response to the bias-mode signal BMS of '10.' In this case, the first bias control signal BCS1 is input to the $p+1^{th}$ buffer in a low period (first output period) of the third bias enable signal B_EN3, and the second bias control signal BCS2 is input to the $p+1^{th}$ buffer in a high period (second output period) of the third bias enable signal B_EN3. Accordingly, the $p+1^{th}$ buffer performs amplification using the first bias current IB1 in the low period of the third bias enable signal B_EN3, and performs amplification using the second bias current IB2 in the high period of the third bias enable signal B_EN3. Accordingly, a total bias current TIBp+1 used by the $p+1^{th}$ buffer in the $n+1^{th}$ display period Tn+1 has a level of the first bias current IB1 in the low period of the third bias enable signal B_EN3, and has a level of the second bias current IB2 in the high period of the third bias enable signal B_EN3.

Herein, since an amount of variation of the image data signal in the $n+1^{th}$ display period Tn+1 is the same as an amount of variation of the image data signal in the $n^{th}$ display period Tn, a data enable signal selected in the $n+1^{th}$ display period Tn_1 has a duty ratio the same as a duty ratio of a data enable signal selected in the $n^{th}$ display period Tn, such that a time period for which the second bias current IB2 is applied to the $p+1^{th}$ buffer in the $n^{th}$ display period Tn is the same as a time period for which the second bias current IB2 is applied to the $p+1^{th}$ buffer in the $n+1^{th}$ display period Tn+1.

Next, image data signals corresponding to a $p+2^{th}$ data line and an operation of a buffer corresponding to the $p+2^{th}$ data line will be described.

The $p+2^{th}$ data driving signal Vp+2 is a signal applied to the $p+2^{th}$ data line, and includes an $n-1^{th}$ analog image data signal applied to the $p+2^{th}$ data line in an $n-1^{th}$ display period Tn−1, an $n^{th}$ analog image data signal applied to the $p+2^{th}$ data line in an $n^{th}$ display period Tn, and an $n+1^{th}$ analog image data signal applied to the $p+2^{th}$ data line in an $n+1^{th}$ display period Tn+1.

The $n-1^{th}$ analog image data signal, the $n^{th}$ analog image data signal, and the $n+1^{th}$ analog image data signal included in the $p+2^{th}$ data driving signal Vp+2 are a positive-polarity signal having a level greater than that of the common voltage Vcom and less than that of the reference voltage AVDD. The $n-1^{th}$ analog image data signal, the $n^{th}$ analog image data signal, and the $n+1^{th}$ analog image data signal each have a gray voltage in a range of level 0 (0G) to level 255 (255G). Here, the term "128G" refers to a gray voltage of level 128. The $n-1^{th}$ analog image data signal included in the $p+2^{th}$ data driving signal Vp+2 is a signal generated based on the $n-1^{th}$ digital image data signal, the $n^{th}$ analog image data signal included in the $p+2^{th}$ data driving signal Vp+2 is a signal generated based on the $n^{th}$ digital image data signal, and the n+1th analog image data signal included in the $p+2^{th}$ data driving signal Vp+2 is a signal generated based on the $n+1^{th}$ digital image data signal.

The $n-1^{th}$ digital image data signal included in the $p+2^{th}$ data driving signal Vp+2 is a 8-bit signal having a digital code of '00xxxxxx,' the $n^{th}$ digital image data signal included in the $p+2^{th}$ data driving signal Vp+2 is a 8-bit signal having a digital code of '11xxxxxx,' and the $n+1^{th}$ digital image data signal included in the $p+2^{th}$ data driving signal Vp+2 is a 8-bit signal having a digital code of '11xxxxxx.' As used herein, "x" is either 0 or 1.

Herein, an operation of the buffer corresponding to the $p+2^{th}$ data line (hereinafter, "$p+2^{th}$ buffer") in the $n^{th}$ display period Tn will be described hereinbelow.

A difference between upper two bits of '00' in the $n-1^{th}$ digital image data signal included in the $p+2^{th}$ data driving signal Vp+2 and upper two bits of '11' in the $n^{th}$ digital image data signal included in the $p+2^{th}$ data driving signal is '11.' Accordingly, a bias-mode signal BMS having a digital code of '11' is output from the bias-mode verification unit 401 corresponding to the $p+2^{th}$ data line. In this case, the data selecting unit 402 corresponding to the $p+2^{th}$ data line selects the fourth bias enable signal B_EN4 in response to the bias-mode signal BMS of '11.' In this case, the first bias control signal BCS1 is input to the $p+2^{th}$ buffer in a low period (first output period) of the fourth bias enable signal B_EN4, and the second bias control signal BCS2 is input to the $p+2^{th}$ buffer in a high period (second output period) of the fourth bias enable signal B_EN4. Accordingly, the $p+2^{th}$ buffer performs amplification using the first bias current IB1 in the low period of the fourth bias enable signal B_EN4, and performs amplification using the second bias current IB2 in the high period of the fourth bias enable signal B_EN4. Accordingly, a total bias current TIBp+2 used by the p+2$^{th}$ buffer in the n$^{th}$ display period Tn has a level of the first bias current IB1 in the low period of the fourth bias enable signal B_EN4, and has a level of the second bias current IB2 in the high period of the fourth bias enable signal B_EN4.

Hereinafter, an operation of the p+2$^{th}$ buffer in the n+1$^{th}$ display period Tn+1 will be described.

A difference between upper two bits of '11' in the n$^{th}$ digital image data signal included in the p+2$^{th}$ data driving signal Vp+2 and upper two bits of '11' in the n+1$^{th}$ digital image data signal included in the p+2$^{th}$ data driving signal is '00.' Accordingly, a bias-mode signal BMS having a digital code of '00' is output from the bias-mode verification unit 401 corresponding to the p+2$^{th}$ data line. In this case, the data selecting unit 402 corresponding to the p+2$^{th}$ data line selects the first bias enable signal B_EN1 in response to the bias-mode signal BMS of '00.' In this case, the first bias control signal BCS1 is input to the p+2$^{th}$ buffer in a low period (first output period) of the first bias enable signal B_EN1, and the second bias control signal BCS2 is input to the p+2$^{th}$ buffer in a high period (second output period) of the first bias enable signal B_EN1. Accordingly, the p+2$^{th}$ buffer performs amplification using the first bias current IB1 in the low period of the first bias enable signal B_EN1, and performs amplification using the second bias current IB2 in the high period of the first bias enable signal B_EN1. Accordingly, a total bias current TIBp+2 used by the p+2$^{th}$ buffer in the n+1$^{th}$ display period Tn+1 has a level of the first bias current IB1 in the low period of the first bias enable signal B_EN1, and has a level of the second bias current IB2 in the high period of the first bias enable signal B_EN1.

Herein, since an amount of variation of the image data signal is less in the n+1$^{th}$ display period Tn+1 than an amount of variation of the image data signal in the n$^{th}$ display period Tn, a data enable signal having a relatively great duty ratio is selected in the n+1$^{th}$ display period Tn_1 as compared to a duty ratio of a data enable signal selected in the n$^{th}$ display period Tn, such that the second bias current IB2 is applied to the p+2$^{th}$ buffer for a longer period of time in the n+1$^{th}$ display period Tn+1 than a period of time for which the second bias enable current IB2 is applied in the n$^{th}$ display period Tn.

Based on the comparison among the total bias currents TIBp, TIBp+1, and TIBp+2 that are consumed by the respective buffers in the respective display periods, the total bias current TIBp of the p$^{th}$ buffer 35*p* is the least in the n$^{th}$ display period Tn, and the total bias current TIBp+2 of the p+2th buffer is the least in the n+1$^{th}$ display period Tn+1.

Although the level of the first bias current IB1 included in the total bias current TIBp of the p$^{th}$ buffer 35*p*, the level of the first bias current IB1 included in the total bias current TIBp+1 of the p+1$^{th}$ buffer, and the level of the first bias current IB1 included in the total bias current TIBp+2 of the p+2$^{th}$ buffer are illustrated as not corresponding to one another in FIG. 9, for ease of description, the first bias currents IB1 included in the respective total bias currents TIBp, TIBp+1, and TIBp+2 each have substantially the same level.

Likewise, although the level of the second bias current IB2 included in the total bias current TIBp of the p$^{th}$ buffer 35*p*, the level of the second bias current IB2 included in the total bias current TIBp+1 of the p+1$^{th}$ buffer, and the level of the second bias current IB2 included in the total bias current TIBp+2 of the p+2$^{th}$ buffer are illustrated as not corresponding to one another in FIG. 9, for ease of description, the second bias currents IB2 included in the respective total bias currents TIBp, TIBp+1, and TIBp+2 each have substantially the same level.

Figure 10:
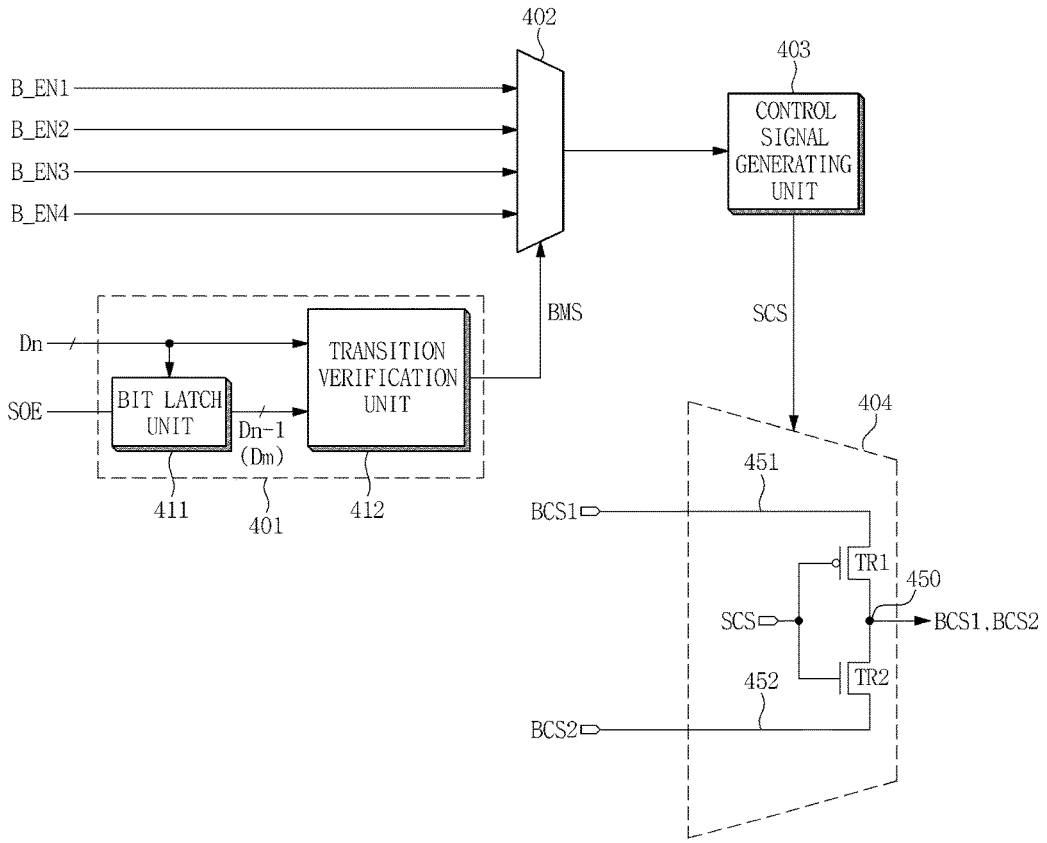
FIG. 10 is another detailed configuration view illustrating a control signal generating unit and a bias control unit of FIG. 4.

FIG. 10 is another detailed configuration view illustrating the control signal generating unit 403 and the bias control unit 404 of FIG. 4.

A control signal generating unit 403 illustrated in FIG. 10 generates a switching control signal SCS based on a bias enable signal selected by a data selecting unit 402. In an exemplary embodiment, the control signal generating unit 403 modulates the level of the selected bias enable signal to thereby generate the switching control signal SCS, for example. The control signal generating unit 403 may be a level shifter that modulates the level of an input signal.

The switching control signal SCS is an analog signal. The switching control signal SCS is an AC signal, and has a phase the same as the phase of the selected bias enable signal. In addition, the switching control signal SCS has a level greater than the level of the selected bias enable signal. In an exemplary embodiment, a high voltage of the switching control signal SCS is greater than a high voltage of the selected bias enable signal, and a low voltage of the switching control signal SCS is less than a low voltage of the bias enable signal, for example. The switching control signal SCS output from the control signal generating unit 403 is applied to a bias control unit 404.

The bias control unit 404 receives the switching control signal SCS from the control signal generating unit 403, and receives a first bias control signal BCS1 and a second bias control signal BCS2 from an integrated control unit 370 (refer to FIG. 8). The bias control unit 404 selects one of the first bias control signal BCS1 and the second bias control signal BCS2 in a first output period and a second output period defined by the switching control signal SCS, and applies the selected bias control signal to the buffer 35*p* (refer to FIG. 4). In an exemplary embodiment, the bias control unit 404 selects the first bias control signal BCS1 to output the selected first bias control signal BCS1 in the first output period, and selects the second bias control signal BCS2 to output the selected second bias control signal BCS2 in the second output period, for example. In an exemplary embodiment, the bias control unit 404 may be a multiplexer, for example.

The first output period corresponds to a low period of the switching control signal SCS. The second output period corresponds to a high period of the switching control signal SCS. The switching control signal SCS maintains a low voltage in the low period of the switching control signal SCS, and maintains a high voltage in the high period thereof.

The length of the first output period corresponds to the length of the low period of the switching control signal SCS. The length of the low period of the switching control signal SCS corresponds to the length of a low period of the selected bias enable signal. On the contrary, the length of the second output period corresponds to the length of the high period of the switching control signal SCS. The length of the high period of the switching control signal SCS corresponds to the length of a high period of the selected bias enable signal.

The first bias control signal BCS1 and the second bias control signal BCS2 output from the bias control unit 404 are provided to the buffer 35*p*. In this case, the first bias control signal BCS1 and the second bias control signal BCS2 are sequentially input to a buffer 35*p*. In an exemplary embodiment, the first bias control signal BCS1 is input to the buffer 35*p* in the first output period, and subsequently, the second bias control signal BCS2 is input to the buffer 35*p* in the second output period, for example.

The bias control unit 404 illustrated in FIG. 10 may include a first input terminal 451 to which the first bias control signal BCS1 is input from the integrated control unit 370, a second input terminal 452 to which the second bias control signal BCS2 is input from the integrated control unit 370, an output terminal 450 connected to the buffer 35*p*, a p-type first switching element TR1, and an n-type second switching element TR2.

The p-type first switching element Tr1 is controlled by the switching control signal SCS, and is connected between the first input terminal 451 and the output terminal 450. The p-type first switching element TR1 is turned on or turned off by the switching control signal SCS, and when being turned on, the p-type first switching element TR1 outputs the first bias control signal BCS1 to the output terminal 450.

The n-type second switching element TR2 is controlled by the switching control signal SCS, and is connected between the second input terminal 452 and the output terminal 450. The n-type second switching element TR2 is turned on or turned off by the switching control signal SCS, and when being turned on, the n-type second switching element TR2 outputs the second bias control signal BCS2 to the output terminal 450.

A high voltage of the switching control signal SCS has a level that may turn on the n-type second switching element TR2, and a low voltage of the switching control signal SCS has a level that may turn on the p-type first switching element TR1.

In a case where the switching control signal SCS has the low voltage in the first output period, the first switching element TR1 is turned on, while the second switching element TR2 is turned off. Accordingly, in the first output period T01 (refer to FIG. 6), the first bias control signal BCS1 is applied to the buffer 35*p* through the first switching element TR1 that is turned on.

In a case where the switching control signal SCS has the high voltage in the second output period, the first switching element TR1 is turned off, while the second switching element TR2 is turned on. Accordingly, in the second output period T02 refer to FIG. 6), the second bias control signal BCS2 is applied to the buffer 35*p* through the second switching element TR2 that is turned on.

As a bias-mode verification unit 401 and the data selecting unit 402 illustrated in FIG. 10 are the same as the bias-mode verification unit 401 and the data selecting unit 402 illustrated in FIG. 5, the description with regard to the bias-mode verification unit 401 and the data selecting unit 402 will make reference to FIG. 5 and related description.

In a case where the buffer requires two or more types of bias currents, the integrated control unit 370 may provide other plurality of pairs of a first bias control signal and a second bias control signal in addition to the aforementioned single pair of the first bias control signal BCS1 and the second bias control signal BCS2. In an exemplary embodiment, in a case where the buffer requires eight-types of bias currents, that is, first to eighth bias currents having different levels from one another, eight pairs of bias control signals (total 16 bias control signals) may be provided, for example. That is, a pair of a first bias control signal and a second bias control signal are provided with respect to the first bias current, another pair of a first bias control signal and a second bias control signal are provided with respect to the second bias current, still another pair of a first bias control signal and a second bias control signal are provided with respect to the third bias current, . . . , and so on, and yet another pair of a first bias control signal and a second bias control signal are provided with respect to the eighth bias current.

In a case where the buffer requires two or more types of bias currents as described in the foregoing, two or more bias control units 404 are provided as well. In an exemplary embodiment, in a case where the buffer requires the first to eighth bias currents as described in the foregoing, eight bias control units 404 are provided, for example. Each of the eight bias control units 404 receives a pair of a first bias control signal and a second bias control signal. In an exemplary embodiment, the first bias control unit 404 may receive a pair of a first bias control signal BCS1 and a second bias control signal BCS2 for controlling the first bias current, the second bias control unit 404 may receive another pair of the first bias control signal and the second bias control signal for controlling the second bias current, and the third bias control unit 404 may receive still another pair of the first bias control signal and the second bias control signal for controlling the third bias current, for example.

The plurality of pairs of the first bias control signal and the second bias control signal output from the respective first to eighth bias control units are provided to a corresponding bias end of the buffer.

However, although the buffer requires two or more types of bias currents as describe in the foregoing, the number of other elements may not vary. In an exemplary embodiment, the first switching control signal SCS1 and the second switching control signal SCS2 generated in the control signal generating unit 403, for example, are applied to each of the first to eighth bias control units as a common signal.

The buffers may receive pairs of a first bias control signal and a second bias control signal, respectively, the pairs having different levels from each other. In an exemplary embodiment, one pair of a first bias control signal BCS1 and a second bias control signal BCS2 applied to the $p^{th}$ buffer 35*p* connected to the $p^{th}$ data line DLp may have a level different from the level of another pair of a first bias control signal and a second bias control signal applied to the p+1th buffer connected to the p+1th data line, for example.

Further, the first bias control signal BCS1 and the second bias control signal BCS2 applied to the buffer may have different levels for each display period.

In addition, in a case where the data driver 111 (refer to FIG. 1) includes a plurality of driving integrated circuits ("IC"), the respective driving ICs may receive pairs of a first bias control signal and a second bias control signal, respectively, the pairs having different levels from one another. In an exemplary embodiment, one pair of first and second bias control signals applied to the buffer of a first data driving IC has a level different from that of another pair of first and second bias control signals applied to the second data driving IC, for example.

The display device according to an exemplary embodiment may further include a switching unit, which will be described in detail with reference to FIG. 11.

Figure 11:
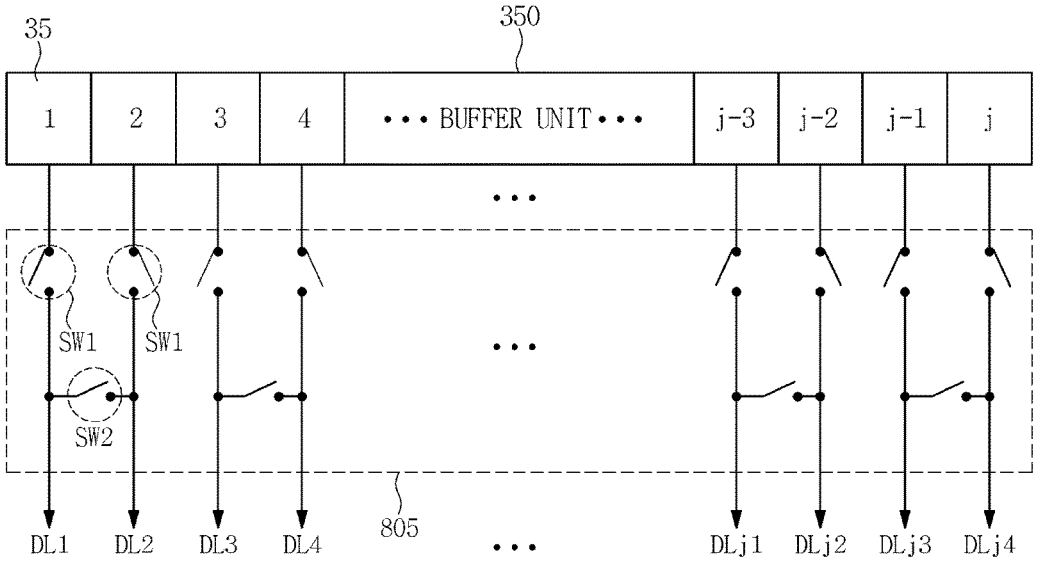
FIG. 11 is a view illustrating a switching unit.

FIG. 11 is a view illustrating a switching unit.

The switching unit 805, as illustrated in FIG. 11, includes an output control switch SW1 and a charge control switch SW2.

The output control switch SW1 is connected to each of the buffers 35 of the buffer unit 350 and each of the data lines.

The charge control switch SW2 is connected between the data lines that are adjacent to each other. In this case, the charge control switch SW2 is connected to a $2y-1^{th}$ data line ("y" is a natural number) and a $2y^{th}$ data line. The charge control switches SW2 are connected between the output control switches SW1 and the data lines.

In the display period, the output control switches SW1 each are turned on, while the charge control switches SW2 are turned off. Accordingly, in the display period, the image data signals may be normally applied to the respective data lines. In a blank period between one display period and another display period, the output control switches SW1 each are turned off, while the charge control switches SW2 each are turned on. In this case, the $2y-1^{th}$ data line and the $2y^{th}$ data line are connected to each other by the turned-on charge control switches SW2. As an image data signal of the $2y-1^{th}$ data line and an image data signal of the $2y^{th}$ data line have opposite polarities from each other, in a case where two data lines that are adjacent to each other are connected to each other similar to the foregoing, a level of the signals respectively charged in the two data lines increases or decreases to the level of the common voltage Vcom. Accordingly, in a succeeding display period, an image data signal, having an opposite polarity, to be applied to each of the data lines may be rapidly charged to the data lines.

As set forth hereinabove, the display device and the method of driving the display device according to the invention has the following effects.

First, a time period of applying the bias current that is provided to the buffer is decreased when an amount of variation of the image data signal is relatively small, such that power consumption of the data driver may be reduced.

Second, two bias control signals having different levels from each other are used, such that the size of the level shifter and the multiplexer may be reduced.

From the foregoing, it will be appreciated that various embodiments in accordance with the disclosure have been described herein for purposes of illustration, and that various modifications may be made without departing from the scope and spirit of the teachings. Accordingly, the various embodiments disclosed herein are not intended to be limiting of the true scope and spirit of the teachings. Various features of the above described and other embodiments can be mixed and matched in any manner, to produce further embodiments consistent with the invention.

What is claimed is:

1. A display device comprising:

a buffer connected to a data line of a display panel;

a bias-mode verification unit which generates a bias-mode signal based on an $n^{th}$ image data signal and an $m^{th}$ image data signal corresponding to the data line where "m" is a natural number smaller than "n";

a data selecting unit which selects one of a plurality of bias enable signals having different duty ratios from one another based on the bias-mode signal;

a control signal generating unit which generates a switching control signal based on the bias enable signal selected by the data selecting unit; and a bias control unit which applies, to the buffer, at least one of a plurality of bias control signals having different levels from one another in an output period defined by the switching control signal.

2. The display device of claim 1, wherein the plurality of bias control signals comprises a first bias control signal and a second bias control signal having a level less than a level of the first bias control signal.

3. The display device of claim 2, wherein the output period comprises at least one first output period corresponding to a low period of the switching control signal; and at least one second output period corresponding to a high period of the switching control signal.

4. The display device of claim 3, wherein the bias control unit outputs the first bias control signal in the first output period and outputs the second bias control signal in the second output period.

5. The display device of claim 2, wherein the bias control unit comprises:

a first input terminal to which one of the first bias control signal and the second bias control signal is input;

a second input terminal to which the other of the first bias control signal and the second bias control signal is input;

an output terminal connected to the buffer;

a p-type first switching element controlled by the switching control signal and connected between the first input terminal and the output terminal; and an n-type second switching element controlled by the switching control signal and connected between the second input terminal and the output terminal.

6. The display device of claim 2, wherein the switching control signal comprises a first switching control signal and a second switching control signal having phases opposite to each other.

7. The display device of claim 6, wherein the output period comprises:

at least one first output period corresponding to a low period of the first switching control signal and a high period of the second switching control signal; and at least one second output period corresponding to a high period of the first switching control signal and a low period of the second switching control signal.

8. The display device of claim 6, wherein the bias control unit comprises:

a first input terminal to which one of the first bias control signal and the second bias control signal is input;

a second input terminal to which the other of the first bias control signal and the second bias control signal is input;

an output terminal connected to the buffer;

a p-type first switching element controlled by the first switching control signal and connected between the first input terminal and the output terminal;

an n-type second switching element controlled by the second switching control signal and connected between the first input terminal and the output terminal;

a p-type third switching element controlled by the second switching control signal and connected between the second input terminal and the output terminal; and an n-type fourth switching element controlled by the first switching control signal and connected between the second input terminal and the output terminal.

9. The display device of claim 6, wherein the first switching control signal and the second switching control signal applied from the control signal generating unit have a level greater than a level of the bias enable signal selected by the data selecting unit.

10. The display device of claim 6, wherein the control signal generating unit comprises:

an input terminal to which the bias enable signal is input from the data selecting unit;

a first output terminal to which the first switching control signal is output;

a second output terminal to which the second switching control signal is output;

an inverting unit which generates an inverted bias enable signal based on the bias enable signal input to the input terminal;

an intermediate control unit which generates a first intermediate control signal and a second intermediate control signal based on the bias enable signal applied from the data selecting unit and the inverted bias enable signal applied from the inverting unit; and an output unit which generates the first switching control signal and the second switching control signal based on the first intermediate control signal and the second intermediate control signal applied from the intermediate control unit and outputs the first switching control signal and the second switching control signal to the first output terminal and the second output terminal.

11. The display device of claim 10, wherein the inverting unit comprises:

a p-type first switching element controlled by the bias enable signal applied from the input terminal and connected between a first high-voltage power line transmitting a first high voltage and an inverting terminal; and an n-type second switching element controlled by the bias enable signal applied from the input terminal and connected between the inverting terminal and a first low-voltage power line transmitting a first low voltage.

12. The display device of claim 11, wherein the intermediate control unit comprises:

an n-type third switching element controlled by the bias enable signal applied from the input terminal and connected between a first intermediate terminal and the first low-voltage power line;

an n-type fourth switching element controlled by the inverted bias enable signal applied from the inverting terminal and connected between a second intermediate terminal and the first low-voltage power line;

a p-type fifth switching element controlled by the second intermediate control signal applied from the second intermediate terminal and connected between a second high-voltage power line transmitting a second high voltage and the first intermediate terminal; and a p-type sixth switching element controlled by the first intermediate control signal applied from the first intermediate terminal and connected between the second high-voltage power line and the second intermediate terminal.

13. The display device of claim 11, wherein the output unit comprises:

a p-type seventh switching element controlled by the first intermediate control signal applied from the first intermediate terminal and connected between the second high-voltage power line and the first output terminal;

a p-type eighth switching element controlled by the second intermediate control signal applied from the second intermediate terminal and connected between the second high-voltage power line and a second output terminal;

an n-type ninth switching element controlled by the second switching control signal applied from the second output terminal and connected between the first output terminal and a second low-voltage power line transmitting a second low voltage; and an n-type tenth switching element controlled by the first switching control signal applied from the first output terminal and connected between the second output terminal and the second low-voltage power line.

14. The display device of claim 2, further comprising an integrated control unit which generates the plurality of bias enable signals, the first bias control signal, and the second bias control signal.

15. The display device of claim 14, wherein the integrated control unit comprises:

a signal applying unit which generates the first bias control signal, a bias level control signal, and a plurality of parameter signals;

a signal modulation unit which generates the second bias control signal based on the first bias control signal and the bias level control signal; and a clock counter which generates the plurality of bias enable signals based on the plurality of parameter signals and an externally input clock signal.

16. The display device of claim 15, wherein the clock counter generates the plurality of bias enable signals based on a count value of the externally input clock signal, a start point in time of the respective bias enable signals included in the plurality of parameter signals, respectively, and an end point in time of the respective bias enable signals included in the plurality of parameter signals, respectively.

17. The display device of claim 1, wherein the switching control signal applied from the control signal generating unit has a level greater than a level of the bias enable signal selected by the data selecting unit.

18. The display device of claim 1, wherein the bias-mode verification unit generates the bias-mode signal based on a difference value between the $n^{th}$ image data signal and the $m^{th}$ image data signal.

19. The display device of claim 18, wherein the bias-mode verification unit generates the bias-mode signal based on a difference value between upper "k" number of bits of the $n^{th}$ image data signal and upper "k" number of bits of the $m^{th}$ image data signal where "k" is a natural number.

20. A method of driving a display device comprising a buffer connected to a data line of a display panel, the method comprising;

generating a bias-mode signal based on an $n^{th}$ image data signal and an $m^{th}$ image data signal corresponding to the data line where "m" is a natural number smaller than "n";

selecting one of a plurality of bias enable signals having different duty ratios from one another based on the bias-mode signal;

generating a switching control signal based on the selected bias enable signal; and applying, to the buffer, at least one of a plurality of bias control signals having different levels from one another in an output period defined by the switching control signal.

21. The method of claim 20, wherein the plurality of bias control signals comprises a first bias control signal and a second bias control signal having a level less than a level of the first bias control signal.

22. The method of claim 21, wherein the output period comprises:

a first output period corresponding to a low period of the switching control signal; and a second output period corresponding to a high period of the switching control signal.

23. The method of claim 22, wherein the applying of at least one of the plurality of bias control signals to the buffer comprises:

applying the first bias control signal to the buffer in the first output period; and applying the second bias control signal to the buffer in the second output period.

24. The method of claim 21, wherein the switching control signal comprises a first switching control signal and a second switching control signal having phases opposite to each other.

25. The method of claim 24, wherein the output period comprises:

a first output period corresponding to a low period of the first switching control signal and a high period of the second switching control signal; and a second output period corresponding to a high period of the first switching control signal and a low period of the second switching control signal.

26. The method of claim 24, wherein the first switching control signal and the second switching control signal have a level greater than a level of the selected bias enable signal.

27. The method of claim 20, wherein the switching control signal has a level greater than a level of the selected bias enable signal.

* * * * *